US010551119B2

(12) United States Patent
Miller et al.

(10) Patent No.: US 10,551,119 B2
(45) Date of Patent: Feb. 4, 2020

(54) HYDROCARBON GAS PROCESSING

(71) Applicants: Ortloff Engineers, Ltd., Midland, TX (US); S.M.E. Products, LP, Houston, TX (US)

(72) Inventors: Scott A. Miller, Midland, TX (US); John D. Wilkinson, Midland, TX (US); Joe T. Lynch, Midland, TX (US); Hank M. Hudson, Midland, TX (US); Kyle T. Cuellar, Katy, TX (US); Andrew F. Johnke, Beresford, SD (US); W. Larry Lewis, Tomball, TX (US)

(73) Assignees: Ortloff Engineers, Ltd., Midland, TX (US); S.M.E. Products LP, Houston, TX (US)

( * ) Notice: Subject to any disclaimer, the term of this patent is extended or adjusted under 35 U.S.C. 154(b) by 455 days.

(21) Appl. No.: 15/332,723

(22) Filed: Oct. 24, 2016

(65) Prior Publication Data

US 2018/0058756 A1 Mar. 1, 2018

Related U.S. Application Data

(60) Provisional application No. 62/380,014, filed on Aug. 26, 2016.

(51) Int. Cl.
*F25J 3/02* (2006.01)

(52) U.S. Cl.
CPC ..... *F25J 3/0214* (2013.01); *F25J 3/0209* (2013.01); *F25J 3/0238* (2013.01); *F25J 3/0257* (2013.01);

(Continued)

(58) Field of Classification Search
CPC ..... F25J 3/0209; F25J 3/0233–0242; F25J 2200/04; F25J 2200/30–32; F25J 2200/80; F25J 2270/88
See application file for complete search history.

(56) References Cited

U.S. PATENT DOCUMENTS 33,408 A 10/1861 Turner et al.
311,402 A 1/1885 Withington
(Continued)

FOREIGN PATENT DOCUMENTS

EP 0182643 A2 5/1986
EP 1114808 A1 7/2001
(Continued)

OTHER PUBLICATIONS

International Search Report and Written Opinion issued in International Application No. PCT/US17/45460 dated Oct. 27, 2017—17 pages.

(Continued)

*Primary Examiner* — Tareq Alosh
(74) *Attorney, Agent, or Firm* — Venable LLP

(57) ABSTRACT

A process and an apparatus are disclosed for a compact processing assembly to improve the recovery of $C_2$ (or $C_3$) and heavier hydrocarbon components from a hydrocarbon gas stream. The preferred method of separating a hydrocarbon gas stream generally includes producing at least a substantially condensed first stream and a cooled second stream, expanding both streams to lower pressure, and supplying the streams to a fractionation tower. In the process and apparatus disclosed, the tower overhead vapor is directed to an absorbing means and a heat and mass transfer means inside a processing assembly. A portion of the outlet vapor from the processing assembly is compressed to higher pressure, cooled and substantially condensed in a heat exchange means inside the processing assembly, then (Continued)

expanded to lower pressure and supplied to the heat and mass transfer means to provide cooling. Condensed liquid from the absorbing means is fed to the tower.

34 Claims, 14 Drawing Sheets

(52) U.S. Cl.
CPC ..... *F25J 3/0295* (2013.01); *F25J 2200/02* (2013.01); *F25J 2200/04* (2013.01); *F25J 2270/88* (2013.01)

(56) References Cited

U.S. PATENT DOCUMENTS 2,603,310 A 7/1952 Gilmore
2,880,592 A 4/1959 Davison et al.
2,952,984 A 9/1960 Marshall
2,952,985 A 9/1960 Brandon
3,292,380 A 12/1966 Bucklin
3,292,980 A 12/1966 Gustafsson et al.
3,477,915 A 11/1969 Gantt et al.
3,507,127 A 4/1970 De Marco
3,508,412 A 4/1970 Yearout
3,516,261 A 6/1970 Hoffman
3,524,897 A 8/1970 Kniel
3,625,017 A 12/1971 Hoffman
3,656,311 A 4/1972 Kaiser
3,675,435 A 7/1972 Jackson et al.
3,724,226 A 4/1973 Pachaly
3,763,658 A 10/1973 Gaumer, Jr. et al.
3,797,261 A 3/1974 Juncker et al.
3,837,172 A 9/1974 Markbreiter et al.
3,902,329 A 9/1975 King, III et al.
3,920,767 A 11/1975 Carter
3,969,450 A 7/1976 Hengstebeck
3,983,711 A 10/1976 Solomon
4,002,042 A 1/1977 Pryor et al.
4,004,430 A 1/1977 Solomon et al.
4,033,735 A 7/1977 Swenson
4,061,481 A 12/1977 Campbell et al.
4,065,278 A 12/1977 Newton et al.
4,115,086 A 9/1978 Jordan et al.
4,127,009 A 11/1978 Phillips
4,132,604 A 1/1979 Alexion et al.
4,140,504 A 2/1979 Campbell et al.
4,157,904 A 6/1979 Campbell et al.
4,171,964 A 10/1979 Campbell et al.
4,185,978 A 1/1980 McGalliard et al.
4,203,741 A 5/1980 Bellinger et al.
4,251,249 A 2/1981 Gulsby
4,278,457 A 7/1981 Campbell et al.
4,284,423 A 8/1981 Eakman et al.
4,318,723 A 3/1982 Holmes et al.
4,322,225 A 3/1982 Bellinger et al.
4,356,014 A 10/1982 Higgins
4,368,061 A 1/1983 Mestrallet et al.
4,404,008 A 9/1983 Rentler et al.
4,430,103 A 2/1984 Gray et al.
4,445,916 A 5/1984 Newton
4,445,917 A 5/1984 Chiu
4,453,958 A 6/1984 Gulsby et al.
4,507,133 A 3/1985 Khan et al.
4,519,824 A 5/1985 Huebel
4,525,185 A 6/1985 Newton
4,545,795 A 10/1985 Liu et al.
4,592,766 A 6/1986 Kumman et al.
4,596,588 A 6/1986 Cook
4,600,421 A 7/1986 Kummann
4,617,039 A 10/1986 Buck
4,657,571 A 4/1987 Gazzi
4,676,812 A 6/1987 Kummann
4,687,499 A 8/1987 Aghili
4,688,399 A 8/1987 Reimann
4,689,063 A 8/1987 Paradowski et al.
4,690,702 A 9/1987 Paradowski et al.
4,698,081 A 10/1987 Aghili
4,705,549 A 11/1987 Sapper
4,707,170 A 11/1987 Ayres et al.
4,710,214 A 12/1987 Sharma et al.
4,711,651 A 12/1987 Sharma et al.
4,718,927 A 1/1988 Bauer et al.
4,720,294 A 1/1988 Lucadamo et al.
4,738,699 A 4/1988 Apffel
4,746,342 A 5/1988 DeLong et al.
4,752,312 A 6/1988 Prible
4,755,200 A 7/1988 Liu et al.
4,793,841 A 12/1988 Burr
4,851,020 A 7/1989 Montgomery, IV
4,854,955 A 8/1989 Campbell et al.
4,869,740 A 9/1989 Campbell et al.
4,881,960 A 11/1989 Ranke et al.
4,889,545 A 12/1989 Campbell et al.
4,895,584 A 1/1990 Buck et al.
RE33,408 E 10/1990 Khan et al.
4,966,612 A 10/1990 Bauer
4,970,867 A 11/1990 Herron et al.
5,114,451 A 5/1992 Rambo et al.
5,114,541 A 5/1992 Bayer
5,255,528 A 10/1993 Dao
5,275,005 A 1/1994 Campbell et al.
5,282,507 A 2/1994 Tongu et al.
5,291,736 A 3/1994 Paradowski
5,316,628 A 5/1994 Collin et al.
5,325,673 A 7/1994 Durr et al.
5,335,504 A 8/1994 Durr et al.
5,339,654 A 8/1994 Cook et al.
5,363,655 A 11/1994 Kikkawa et al.
5,365,740 A 11/1994 Kikkawa et al.
5,367,884 A 11/1994 Phillips et al.
5,410,885 A 5/1995 Smolarek et al.
5,421,165 A 6/1995 Paradowski et al.
5,537,827 A 7/1996 Low et al.
5,546,764 A 8/1996 Mehra
5,555,748 A 9/1996 Campbell et al.
5,566,554 A 10/1996 Vijayaraghavan et al.
5,568,737 A 10/1996 Campbell et al.
5,600,969 A 2/1997 Low
5,615,561 A 4/1997 Houshmand et al.
5,651,269 A 7/1997 Prevost et al.
5,669,234 A 9/1997 Houser et al.
5,675,054 A 10/1997 Manley et al.
5,685,170 A 11/1997 Sorensen
5,713,216 A 2/1998 Erickson
5,737,940 A 4/1998 Yao et al.
5,755,114 A 5/1998 Foglietta
5,755,115 A 5/1998 Manley
5,771,712 A 6/1998 Campbell et al.
5,799,507 A 9/1998 Wilkinson et al.
5,881,569 A 3/1999 Campbell et al.
5,890,377 A 4/1999 Foglietta
5,890,378 A 4/1999 Rambo et al.
5,893,274 A 4/1999 Nagelvoort et al.
5,942,164 A 8/1999 Tran
5,950,453 A 9/1999 Bowen et al.
5,970,742 A 10/1999 Agrawal et al.
5,983,664 A 11/1999 Campbell et al.
5,992,175 A 11/1999 Yao et al.
6,014,869 A 1/2000 Elion et al.
6,016,665 A 1/2000 Cole et al.
6,023,942 A 2/2000 Thomas et al.
6,053,007 A 4/2000 Victory et al.
6,062,041 A 5/2000 Kikkawa et al.
6,077,985 A 6/2000 Stork
6,116,050 A 9/2000 Yao et al.
6,119,479 A 9/2000 Roberts et al.
6,125,653 A 10/2000 Shu et al.
6,182,469 B1 2/2001 Campbell et al.
6,237,365 B1 5/2001 Trebble
6,244,070 B1 6/2001 Lee et al.
6,250,105 B1 6/2001 Kimble
6,269,655 B1 8/2001 Roberts et al.
6,272,882 B1 8/2001 Hodges et al.

(56) References Cited

U.S. PATENT DOCUMENTS

| | | | |
|---|---|---|---|
| 6,308,531 | B1 | 10/2001 | Roberts et al. |
| 6,324,867 | B1 | 12/2001 | Fanning et al. |
| 6,336,344 | B1 | 1/2002 | O'Brien |
| 6,347,532 | B1 | 2/2002 | Agrawal et al. |
| 6,361,582 | B1 | 3/2002 | Pinnau et al. |
| 6,363,744 | B2 | 4/2002 | Finn et al. |
| 6,367,286 | B1 | 4/2002 | Price |
| 6,401,486 | B1 | 6/2002 | Lee et al. |
| 6,417,420 | B1 | 7/2002 | Stewart et al. |
| 6,453,698 | B2 | 9/2002 | Jain et al. |
| 6,516,631 | B1 | 2/2003 | Trebble |
| 6,526,777 | B1 | 3/2003 | Campbell et al. |
| 6,550,274 | B1 | 4/2003 | Agrawal |
| 6,564,579 | B1 | 5/2003 | McCartney |
| 6,565,626 | B1 | 5/2003 | Baker et al. |
| 6,578,379 | B2 | 6/2003 | Paradowski |
| 6,604,380 | B1 | 8/2003 | Reddick et al. |
| 6,694,775 | B1 | 2/2004 | Higginbotham et al. |
| 6,712,880 | B2 | 3/2004 | Fogietta et al. |
| 6,742,358 | B2 | 6/2004 | Wilkinson et al. |
| 6,889,523 | B2 | 5/2005 | Wilkinson et al. |
| 6,907,752 | B2 | 6/2005 | Schroeder et al. |
| 6,915,662 | B2 | 7/2005 | Wilkinson et al. |
| 6,941,771 | B2 | 9/2005 | Reddick et al. |
| 6,945,075 | B2 | 9/2005 | Wilkinson et al. |
| 6,986,266 | B2 | 1/2006 | Narinsky |
| 7,010,937 | B2 | 3/2006 | Wilkinson et al. |
| 7,069,743 | B2 | 7/2006 | Prim |
| 7,107,788 | B2 | 9/2006 | Patel et al. |
| 7,155,931 | B2 | 1/2007 | Wilkinson et al. |
| 7,159,417 | B2 | 1/2007 | Foglietta et al. |
| 7,165,423 | B2 | 1/2007 | Winningham |
| 7,191,617 | B2 | 3/2007 | Cuellar et al. |
| 7,204,100 | B2 | 4/2007 | Wilkinson et al. |
| 7,210,311 | B2 | 5/2007 | Wilkinson et al. |
| 7,216,507 | B2 | 5/2007 | Cuellar et al. |
| 7,219,513 | B1 | 5/2007 | Mostafa |
| 7,273,542 | B2 | 9/2007 | Duhon et al. |
| 7,278,281 | B2 | 10/2007 | Yang et al. |
| 7,357,003 | B2 | 4/2008 | Ohara et al. |
| 7,475,566 | B2 | 1/2009 | Schroeder et al. |
| 7,565,815 | B2 | 7/2009 | Wilkinson et al. |
| 7,631,516 | B2 | 12/2009 | Cuellar et al. |
| 7,666,251 | B2 | 2/2010 | Shah et al. |
| 7,713,497 | B2 | 5/2010 | Mak |
| 7,714,180 | B2 | 5/2010 | Duhon et al. |
| 8,156,758 | B2 | 4/2012 | Denton et al. |
| 8,434,325 | B2 | 5/2013 | Martinez et al. |
| 8,590,340 | B2 | 11/2013 | Pitman et al. |
| 8,667,812 | B2 | 3/2014 | Cuellar et al. |
| 8,794,029 | B2 | 8/2014 | Yokohata et al. |
| 8,794,030 | B2 | 8/2014 | Martinez et al. |
| 8,850,849 | B2 | 10/2014 | Martinez et al. |
| 8,881,549 | B2 | 11/2014 | Johnke et al. |
| 8,919,148 | B2 | 12/2014 | Wilkinson et al. |
| 9,021,831 | B2 | 5/2015 | Johnke et al. |
| 9,021,832 | B2 | 5/2015 | Pierce et al. |
| 9,052,136 | B2 | 6/2015 | Johnke et al. |
| 9,052,137 | B2 | 6/2015 | Johnke et al. |
| 9,057,558 | B2 | 6/2015 | Johnke et al. |
| 9,068,774 | B2 | 6/2015 | Johnke et al. |
| 9,074,814 | B2 | 7/2015 | Johnke et al. |
| 9,080,810 | B2 | 7/2015 | Pitman et al. |
| 9,080,811 | B2 | 7/2015 | Johnke et al. |
| 9,476,639 | B2 | 10/2016 | Martinez et al. |
| 2001/0008073 | A1 | 7/2001 | Finn et al. |
| 2002/0166336 | A1 | 11/2002 | Wilkinson et al. |
| 2003/0005722 | A1 | 1/2003 | Wilkinson et al. |
| 2003/0158458 | A1 | 8/2003 | Prim |
| 2004/0079107 | A1 | 4/2004 | Wilkinson et al. |
| 2004/0172967 | A1 | 9/2004 | Patel et al. |
| 2005/0061029 | A1 | 3/2005 | Narinsky |
| 2005/0155381 | A1 | 7/2005 | Yang et al. |
| 2005/0229634 | A1 | 10/2005 | Huebel et al. |
| 2005/0247078 | A1 | 11/2005 | Wilkinson et al. |
| 2005/0268649 | A1 | 12/2005 | Wilkinson et al. |
| 2006/0032269 | A1 | 2/2006 | Cellar et al. |
| 2006/0086139 | A1 | 4/2006 | Eaton et al. |
| 2006/0130521 | A1 | 6/2006 | Patel |
| 2006/0260355 | A1 | 11/2006 | Roberts et al. |
| 2006/0283207 | A1 | 12/2006 | Pitman et al. |
| 2007/0001322 | A1 | 1/2007 | Aikhorin et al. |
| 2008/0000265 | A1 | 1/2008 | Cuellar et al. |
| 2008/0078205 | A1 | 4/2008 | Cuellar et al. |
| 2008/0141712 | A1 | 6/2008 | Verma |
| 2008/0190136 | A1 | 8/2008 | Pitman et al. |
| 2008/0271480 | A1 | 11/2008 | Mak |
| 2008/0282731 | A1 | 11/2008 | Cuellar et al. |
| 2009/0107174 | A1 | 4/2009 | Ambari et al. |
| 2009/0107175 | A1 | 4/2009 | Patel et al. |
| 2009/0113930 | A1 | 5/2009 | Patel et al. |
| 2009/0282865 | A1 | 11/2009 | Martinez et al. |
| 2009/0293538 | A1 | 12/2009 | Wilkinson et al. |
| 2010/0251764 | A1 | 10/2010 | Johnke et al. |
| 2010/0275647 | A1 | 11/2010 | Johnke et al. |
| 2010/0287982 | A1 | 11/2010 | Martinez et al. |
| 2010/0287983 | A1 | 11/2010 | Johnke et al. |
| 2010/0287984 | A1 | 11/2010 | Johnke et al. |
| 2010/0326134 | A1 | 12/2010 | Johnke et al. |
| 2011/0067441 | A1 | 3/2011 | Martinez et al. |
| 2011/0067442 | A1 | 3/2011 | Martinez et al. |
| 2011/0067443 | A1 | 3/2011 | Martinez et al. |
| 2011/0226011 | A1 | 9/2011 | Johnke et al. |
| 2011/0226013 | A1 | 9/2011 | Johnke et al. |
| 2011/0232328 | A1 | 9/2011 | Johnke et al. |
| 2012/0000245 | A1 | 1/2012 | Currence et al. |
| 2013/0125582 | A1 | 5/2013 | Martinez et al. |
| 2015/0073194 | A1 | 3/2015 | Hudson et al. |
| 2015/0073195 | A1 | 3/2015 | Lynch et al. |
| 2015/0073196 | A1 | 3/2015 | Miller et al. |
| 2015/0253074 | A1 | 9/2015 | Pitman et al. |
| 2015/0315104 | A2 | 11/2015 | Hudson et al. |
| 2016/0069610 | A1 | 3/2016 | Anguiano et al. |

FOREIGN PATENT DOCUMENTS

| | | | |
|---|---|---|---|
| FR | 1535846 | A | 8/1968 |
| GB | 2102931 | A | 2/1983 |
| SU | 1606828 | A1 | 10/1986 |
| WO | 99/23428 | A1 | 5/1999 |
| WO | 99/37962 | A1 | 7/1999 |
| WO | 00/33006 | A1 | 6/2000 |
| WO | 00/34724 | A1 | 6/2000 |
| WO | 01/88447 | A1 | 11/2001 |
| WO | 02/14763 | A1 | 2/2002 |
| WO | 2002101307 | A1 | 12/2002 |
| WO | 2004/076946 | A2 | 9/2004 |
| WO | 2004/080936 | A1 | 9/2004 |
| WO | 2004/109180 | A1 | 12/2004 |
| WO | 2005/015100 | A1 | 2/2005 |
| WO | 2005/035692 | A2 | 4/2005 |
| WO | 2007/001669 | A2 | 1/2007 |
| WO | 2008/066570 | A2 | 6/2008 |
| WO | 2009/010558 | A2 | 1/2009 |

OTHER PUBLICATIONS

International Search Report and Written Opinion issued in International Application No. PCT/US17/45457 dated Nov. 6, 2017—17 pages.

International Search Report and Written Opinion issued in International Application No. PCT/US17/45454 dated Oct. 25, 2017—17 pages.

Lynch et al., Retrofitting the Williams Energy Services Ignacio Plant for Higher Throughput and Recovery, 78th Annual Convention of the Gas Processors Association, Mar. 3, 1999.

Lynch et al., Retrofit of the Amerada Hess Sea Robin Plant for Very High Ethane Recovery, Gas Processors Association 84th Annual Convention, Mar. 13-16, 2005.

Pending U.S. Appl. No. 15/332,670, filed Oct. 24, 2016.

Pending U.S. Appl. No. 15/332,706, filed Oct. 24, 2016.

(56) References Cited

OTHER PUBLICATIONS

Amendment filed in U.S. Appl. No. 11/839,693, dated Apr. 4, 2016 (146 pages).
Office Action issued in U.S. Appl. No. 11/839,693, dated Jul. 12, 2016 (29 pages).
Amendment and Declaration filed in U.S. Appl. No. 12/868,993, dated May 18, 2016 (71 pages).
Office Action issued in U.S. Appl. No. 12/868,993, dated Sep. 8, 2016 (26 pages).
Response filed in U.S. Appl. No. 12/772,472, dated May 16, 2016 (47 pages).
Office Action issued in U.S. Appl. No. 12/772,472, dated Aug. 23, 2016 (18 pages).
Amendment filed in U.S. Appl. No. 12/781,259, dated May 17, 2016 (40 pages).
Office Action issued in U.S. Appl. No. 12/781,259, dated Aug. 23, 2016 (15 pages).
Response filed in U.S. Appl. No. 12/792,136, dated May 17, 2016 (32 pages).
Office Action issued in U.S. Appl. No. 12/792,136, dated Aug. 22, 2016 (10 pages).
Amendment and Declaration filed in U.S. Appl. No. 12/869,139, dated May 9, 2016 (54 pages).
Office Action issued in U.S. Appl. No. 12/869,139, dated Aug. 23, 2016 (17 pages).
Pending U.S. Appl. No. 15/259,891, filed Sep. 8, 2016.
Amendment filed in U.S. Appl. No. 11/839,693, dated Jan. 12, 2017 (150 pages).
Amendment and Declaration filed in U.S. Appl. No. 12/868,993, dated Mar. 8, 2017 (47 pages).
Amendment and Declaration filed in U.S. Appl. No. 12/772,472, dated Feb. 23, 2017 (75 pages).
Applicant-Initiated Interview Summary issued in U.S. Appl. No. 12/772,472, dated Mar. 13, 2017 (4 pages).
Amendment and Declaration filed in U.S. Appl. No. 12/781,259, dated Feb. 23, 2017 (69 pages).
Applicant-Initiated Interview Summary issued in U.S. Appl. No. 12/781,259, dated Mar. 15, 2017 (4 pages).
Amendment and Declaration filed in U.S. Appl. No. 12/792,136, dated Feb. 22, 2017 (65 pages).
Applicant-Initiated Interview Summary issued in U.S. Appl. No. 12/792,136, dated Mar. 13, 2017 (4 pages).
Amendment and Declaration filed in U.S. Appl. No. 12/869,139, dated Feb. 23, 2017 (29 pages).
Office Action issued in U.S. Appl. No. 14/462,083, dated Dec. 29, 2016 (6 pages).
Response filed in U.S. Appl. No. 14/462,083, dated Mar. 10, 2017 (3 pages).
Office Action issued in U.S. Appl. No. 14/462,069, dated Dec. 30, 2016 (6 pages).
Response filed in U.S. Appl. No. 14/462,069, dated Mar. 10, 2017 (3 pages).
Office Action issued in U.S. Appl. No. 11/839,693, dated Apr. 10, 2017 (33 pages).
Office Action issued in U.S. Appl. No. 12/772,472, dated Mar. 24, 2017 (33 pages).
Response filed in U.S. Appl. No. 12/772,472, dated Apr. 7, 2017 (86 pages).
Advisory Action issued in U.S. Appl. No. 12/772,472, dated May 12, 2017 (3 pages).
Office Action issued in U.S. Appl. No. 12/781,259, dated Mar. 27, 2017 (23 pages).
Response filed in U.S. Appl. No. 12/781,259, dated Apr. 12, 2017 (76 pages).
Office Action issued in U.S. Appl. No. 12/792,136 dated Mar. 27, 2017 (19 pages).
Statement of Substance of Interview filed in U.S. Appl. No. 12/792,136, dated Apr. 13, 2017 (9 pages).
Response filed in U.S. Appl. No. 12/792,136, dated Apr. 18, 2017 (67 pages).
International Search Report and Written Opinion issued in International Application No. PCT/US2010/062402 dated Feb. 25, 2011—11 pages.
International Search Report and Written Opinion issued in International Application No. PCT/US07/76199 dated Mar. 3, 2008—33 pages.
International Search Report and Written Opinion issued in International Application No. PCT/US2008/052154 dated Oct. 14, 2008—24 pages.
International Search Report and Written Opinion issued in International Application No. PCT/US06/18932 dated Sep. 26, 2007—8 pages.
International Search Report and Written Opinion issued in International Application No. PCT/US2008/079984 dated Dec. 19, 2008—6 pages.
International Search Report and Written Opinion issued in International Application No. PCT/US2010/034732 dated Jul. 15, 2010—11 pages.
International Search Report and Written Opinion issued in International Application No. PCT/US2010/046953 dated Oct. 25, 2010—14 pages.
International Search Report and Written Opinion issued in International Application No. PCT/US2010/046966 dated Oct. 15, 2010—20 pages.
International Search Report and Written Opinion issued in International Application No. PCT/US2010/046967 dated Oct. 20, 2010—6 pages.
International Search Report and Written Opinion issued in International Application No. PCT/US2011/029409 dated May 17, 2011—14 pages.
International Search Report and Written Opinion issued in International Application No. PCT/US2011/038303 dated Sep. 2, 2011—9 pages.
Fig. 16-33 on p. 16-24 of the Engineering Data Book, Twelfth Edition, published by the Gas Processors Suppliers Association (2004).
Huang et al., "Select the Optimum Extraction Method for LNG Regasification; Varying Energy Compositions of LNG Imports may Require Terminal Operators to Remove C2+ Compounds before Injecting Regasified LNG into Pipelines," Hydrocarbon Processing, 83, 57-62, Jul. 2004.
Yang et al., "Cost-Effective Design Reduces C2 and C3 at LNG Receiving Terminals," Oil and Gas Journal, 50-53, May 26, 2003.
Finn et al., "LNG Technology for Offshore and Mid-Scale Plants," Proceedings of the Seventy-Ninth Annual Convention of the Gas Processors Association, pp. 429-450, Atlanta, Georgia, Mar. 13-15, 2000.
Kikkawa et al., "Optimize the Power System of Baseload LNG Plant," Proceedings of the Eightieth Annual Convention of the Gas Processors Association, San Antonio, Texas, Mar. 12-14, 2001.
Price, Brian C., "LNG Production for Peak Shaving Operations," Proceedings of the Seventy-Eighth Annual Convention of the Gas Processors Association, pp. 273-280, Nashville, Tennessee, Mar. 1-3, 1999.
Applicant-Initiated Interview Summary issued in U.S. Appl. No. 13/052,348, dated Feb. 20, 2015 (4 pages).
Applicant-Initiated Interview Summary issued in U.S. Appl. No. 13/053,792, dated Mar. 6, 2015 (4 pages).
Amendment, Statement of Interview, and Petition for Extension of Time filed in U.S. Appl. No. 12/689,616 dated Nov. 6, 2014 (30 pages).
Supplemental Notice of Allowability issued in U.S. Appl. No. 12/689,616, dated Feb. 10, 2015 (12 pages).
Comments on Statement of Reasons for Allowance filed in U.S. Appl. No. 12/689,616, dated Mar. 3, 2015 (7 pages).
Response and Statement of Interview filed in U.S. Appl. No. 13/052,575, dated Mar. 16, 2015 (37 pages).
Response and Statement of Interview filed in U.S. Appl. No. 13/052,348, dated Mar. 17, 2015 (37 pages).
Response and Statement of Interview filed in U.S. Appl. No. 13/053,792, dated Mar. 18, 2015 (37 pages).

(56) References Cited

OTHER PUBLICATIONS

Response, Statement of Interview and Petition for Extension of Time filed in U.S. Appl. No. 13/051,682, dated Mar. 19, 2015 (37 pages).
Response, Statement of Interview and Petition for Extension of Time filed in U.S. Appl. No. 13/048,315, dated Mar. 20, 2015 (93 pages).
Amendment and Statement of Interview filed in U.S. Appl. No. 13/052,348, dated Mar. 26, 2015 (23 pages).
Amendment and Statement of Interview filed in U.S. Appl. No. 13/051,682, dated Mar. 26, 2015 (29 pages).
Amendment and Statement of Interview filed in U.S. Appl. No. 13/053,792, dated Mar. 26, 2015 (25 pages).
Amendment and Statement of Interview filed in U.S. Appl. No. 13/052,575, dated Mar. 26, 2015 (20 pages).
Notice of Allowance and Fee(s) Due issued in U.S. Appl. No. 12/689,616, dated Jan. 9, 2015 (15 pages).
Comments on Statement of Reasons for Allowance filed in U.S. Appl. No. 12/689,616, dated Jan. 30, 2015 (8 pages).
Office Action issued in U.S. Appl. No. 13/052,348, dated Dec. 17, 2014 (13 pages).
Office Action issued in U.S. Appl. No. 13/051,682, dated Dec. 18, 2014 (13 pages).
office Action issued in U.S. Appl. No. 13/053,792, dated Dec. 18, 2014 (20 pages).
Office Action issued in U.S. Appl. No. 13/052,575, dated Dec. 16, 2014 (16 pages).
Advisory Action Before the Filing of an Appeal Brief issued in U.S. Appl. No. 12/689,616, dated Nov. 28, 2014 (3 pages).
Submission Under 37 C.F.R. § 1.114, Statement of Interview, and Petition for Extension of Time filed in U.S. Appl. No. 12/689,616, dated Dec. 8, 2014 (39 pages).
International Search Report and Written Opinion issued in International Application No. PCT/US2011/028872 dated May 18, 2011—7 pages.
International Search Report and Written Opinion issued in International Application No. PCT/US2011/29234 dated May 20, 2011—30 pages.
International Search Report and Written Opinion issued in International Application No. PCT/US2011/029034 dated Jul. 27, 2011—40 pages.
International Search Report and Written Opinion issued in International Application No. PCT/US2011/029409 dated May 17, 2011—15 pages.
International Search Report and Written Opinion issued in International Application No. PCT/US2011/029239 dated May 20, 2011—21 pages.
E. Ross Mowrey, "Efficient, High Recovery of Liquids From Natural Gas Utilizing a High Pressure Absorber," Proceedings of the Eighty-First Annual Convention of the Gas Processors Association, Dallas, Texas, Mar. 11-13, 2002.
"Dew Point Control Gas Conditioning Units," SME Products Brochure, Gas Processors Assoc. Conference (Apr. 5, 2009).
"Fuel Gas Conditioning Units for Compressor Engines," SME Products Brochure, Gas Processors Assoc. Conference (Apr. 5, 2009).
"P&ID Fuel Gas Conditioner," Drawing No. SMEP-901, Date Drawn: Aug. 29, 2007, SME, available at http://www.sme-llc.com/sme.cfm?a=prd&catID=58&subID=44&prdID=155 (Apr. 24, 2009).
"Fuel Gas Conditioner Preliminary Arrangement," Drawing No. SMP-1007-00, Date Drawn: Nov. 11, 2008, SME, available at http://www.sme-llc.com/sme.cfm?a=prd&catID=58&subID=44&prdID=155 (Apr. 24, 2009).
"Product: Fuel Gas Conditioning Units," SME Associates, LLC, available at http://www.smellc.com/sme.cfm?a=prd&catID=58&subID=44&prdID=155 (Apr. 24, 2009).
International Search Report and Written Opinion issued in International Application No. PCT/US2010/21364 dated Mar. 29, 2010—20 pages.
International Search Report and Written Opinion issued in International Application No. PCT/US2010/26185 dated Jul. 9, 2010—20 pages.
International Search Report and Written Opinion issued in corresponding International Application No. PCT/US2010/29331 dated Jul. 2, 2010—15 pages.
International Search Report and Written Opinion issued in International Application No. PCT/US2010/33374 dated Jul. 9, 2010—18 pages.
International Search Report and Written Opinion issued in International Application No. PCT/US2010/35121 dated Jul. 19, 2010—18 pages.
International Search Report and Written Opinion issued in International Application No. PCT/US2010/37098 dated Aug. 17, 2010—12 pages.
International Search Report and Written Opinion issued in International Application No. PCT/US14/51544 dated Nov. 24, 2014—16 pages.
Huebel, R., et al., "New NGL-Recovery Process Provides Viable Alternative", Oil & Gas Journal, Jan. 9, 2012 (9 pages).
International Search Report and Written Opinion issued in International Application No. PCT/US14/51547 dated Nov. 24, 2014—21 pages.
International Search Report and Written Opinion issued in International Application No. PCT/US14/51548 dated Nov. 25, 2014—24 pages.

HYDROCARBON GAS PROCESSING

This invention relates to a process and apparatus for improving the separation of a gas containing hydrocarbons. Assignees S. M. E. Products L P and Ortloff Engineers, Ltd. were parties to a joint research agreement that was in effect before the invention of this application was made. The applicants claim the benefits under Title 35, United States Code, Section 119(e) of prior U.S. Provisional Application No. 62/380,014 which was filed on Aug. 26, 2016.

BACKGROUND OF THE INVENTION

Ethylene, ethane, propylene, propane, and/or heavier hydrocarbons can be recovered from a variety of gases, such as natural gas, refinery gas, and synthetic gas streams obtained from other hydrocarbon materials such as coal, crude oil, naphtha, oil shale, tar sands, and lignite. Natural gas usually has a major proportion of methane and ethane, i.e., methane and ethane together comprise at least 50 mole percent of the gas. The gas also contains relatively lesser amounts of heavier hydrocarbons such as propane, butanes, pentanes, and the like, as well as hydrogen, nitrogen, carbon dioxide, and/or other gases.

The present invention is generally concerned with improving the recovery of ethylene, ethane, propylene, propane, and heavier hydrocarbons from such gas streams. A typical analysis of a gas stream to be processed in accordance with this invention would be, in approximate mole percent, 87.3% methane, 8.4% ethane and other $C_2$ components, 2.6% propane and other $C_3$ components, 0.3% iso-butane, 0.4% normal butane, and 0.2% pentanes plus, with the balance made up of nitrogen and carbon dioxide. Sulfur containing gases are also sometimes present.

The historically cyclic fluctuations in the prices of both natural gas and its natural gas liquid (NGL) constituents have at times reduced the incremental value of ethane, ethylene, propane, propylene, and heavier components as liquid products. This has resulted in a demand for processes that can provide more efficient recoveries of these products, for processes that can provide efficient recoveries with lower capital investment, and for processes that can be easily adapted or adjusted to vary the recovery of a specific component over a broad range. Available processes for separating these materials include those based upon cooling and refrigeration of gas, oil absorption, and refrigerated oil absorption. Additionally, cryogenic processes have become popular because of the availability of economical equipment that produces power while simultaneously expanding and extracting heat from the gas being processed. Depending upon the pressure of the gas source, the richness (ethane, ethylene, and heavier hydrocarbons content) of the gas, and the desired end products, each of these processes or a combination thereof may be employed.

The cryogenic expansion process is now generally preferred for natural gas liquids recovery because it provides maximum simplicity with ease of startup, operating flexibility, good efficiency, safety, and good reliability. U.S. Pat. Nos. 3,292,380; 4,061,481; 4,140,504; 4,157,904; 4,171,964; 4,185,978; 4,251,249; 4,278,457; 4,519,824; 4,617,039; 4,687,499; 4,689,063; 4,690,702; 4,854,955; 4,869,740; 4,889,545; 5,275,005; 5,555,748; 5,566,554; 5,568,737; 5,771,712; 5,799,507; 5,881,569; 5,890,378; 5,983,664; 6,182,469; 6,578,379; 6,712,880; 6,915,662; 7,191,617; 7,219,513; 8,590,340; 8,881,549; 8,919,148; 9,021,831; 9,021,832; 9,052,136; 9,052,137; 9,057,558; 9,068,774; 9,074,814; 9,080,810; 9,080,811; and 9,476,639; reissue U.S. Pat. No. 33,408; and co-pending application Ser. Nos. 11/839,693; 12/772,472; 12/781,259; 12/868,993; 12/869,139; 14/462,056; 14/462,083; 14/714,912; and 14/828,093 describe relevant processes (although the description of the present invention in some cases is based on different processing conditions than those described in the cited U.S. Patents and co-pending applications).

In a typical cryogenic expansion recovery process, a feed gas stream under pressure is cooled by heat exchange with other streams of the process and/or external sources of refrigeration such as a propane compression-refrigeration system. As the gas is cooled, liquids may be condensed and collected in one or more separators as high-pressure liquids containing some of the desired $C_2$+ components. Depending on the richness of the gas and the amount of liquids formed, the high-pressure liquids may be expanded to a lower pressure and fractionated. The vaporization occurring during expansion of the liquids results in further cooling of the stream. Under some conditions, pre-cooling the high pressure liquids prior to the expansion may be desirable in order to further lower the temperature resulting from the expansion. The expanded stream, comprising a mixture of liquid and vapor, is fractionated in a distillation (demethanizer or deethanizer) column. In the column, the expansion cooled stream(s) is (are) distilled to separate residual methane, nitrogen, and other volatile gases as overhead vapor from the desired $C_2$ components, $C_3$ components, and heavier hydrocarbon components as bottom liquid product, or to separate residual methane, $C_2$ components, nitrogen, and other volatile gases as overhead vapor from the desired $C_3$ components and heavier hydrocarbon components as bottom liquid product.

If the feed gas is not totally condensed (typically it is not), the vapor remaining from the partial condensation can be split into two streams. One portion of the vapor is passed through a work expansion machine or engine, or an expansion valve, to a lower pressure at which additional liquids are condensed as a result of further cooling of the stream. The pressure after expansion is essentially the same as the pressure at which the distillation column is operated. The combined vapor-liquid phases resulting from the expansion are supplied as feed to the column.

The remaining portion of the vapor is cooled to substantial condensation by heat exchange with other process streams, e.g., the cold fractionation tower overhead. Some or all of the high-pressure liquid may be combined with this vapor portion prior to cooling. The resulting cooled stream is then expanded through an appropriate expansion device, such as an expansion valve, to the pressure at which the demethanizer is operated. During expansion, a portion of the liquid will vaporize, resulting in cooling of the total stream. The flash expanded stream is then supplied as top feed to the demethanizer. Typically, the vapor portion of the flash expanded stream and the demethanizer overhead vapor combine in an upper separator section in the fractionation tower as residual methane product gas. Alternatively, the cooled and expanded stream may be supplied to a separator to provide vapor and liquid streams. The vapor is combined with the tower overhead and the liquid is supplied to the column as a top column feed.

In the ideal operation of such a separation process, the residue gas leaving the process will contain substantially all of the methane in the feed gas with essentially none of the heavier hydrocarbon components, and the bottoms fraction leaving the demethanizer will contain substantially all of the heavier hydrocarbon components with essentially no methane or more volatile components. In practice, however, this ideal situation is not obtained because the conventional demethanizer is operated largely as a stripping column. The methane product of the process, therefore, typically comprises vapors leaving the top fractionation stage of the column, together with vapors not subjected to any rectification step. Considerable losses of $C_2$, $C_3$, and $C_4$+ components occur because the top liquid feed contains substantial quantities of these components and heavier hydrocarbon components, resulting in corresponding equilibrium quantities of $C_2$ components, $C_3$ components, $C_4$ components, and heavier hydrocarbon components in the vapors leaving the top fractionation stage of the demethanizer. The loss of these desirable components could be significantly reduced if the rising vapors could be brought into contact with a significant quantity of liquid (reflux) capable of absorbing the $C_2$ components, $C_3$ components, $C_4$ components, and heavier hydrocarbon components from the vapors.

In recent years, the preferred processes for hydrocarbon separation use an upper absorber section to provide additional rectification of the rising vapors. For many of these processes, the source of the reflux stream for the upper rectification section is a recycled stream of residue gas supplied under pressure. The recycled residue gas stream is usually cooled to substantial condensation by heat exchange with other process streams, e.g., the cold fractionation tower overhead. The resulting substantially condensed stream is then expanded through an appropriate expansion device, such as an expansion valve, to the pressure at which the demethanizer is operated. During expansion, a portion of the liquid will usually vaporize, resulting in cooling of the total stream. The flash expanded stream is then supplied as top feed to the demethanizer. Typical process schemes of this type are disclosed in U.S. Pat. Nos. 4,889,545; 5,568,737; 5,881,569; 9,052,137; and 9,080,811 and in Mowrey, E. Ross, "Efficient, High Recovery of Liquids from Natural Gas Utilizing a High Pressure Absorber", Proceedings of the Eighty-First Annual Convention of the Gas Processors Association, Dallas, Tex., Mar. 11-13, 2002. Unfortunately, in addition to the additional rectification section in the demethanizer, these processes also require surplus compression capacity to provide the motive force for recycling the reflux stream to the demethanizer, adding to both the capital cost and the operating cost of facilities using these processes.

Another means of providing a reflux stream for the upper rectification section is to withdraw a distillation vapor stream from a lower location on the tower (and perhaps combine it with a portion of the tower overhead vapor). This vapor (or combined vapor) stream is compressed to higher pressure, then cooled to substantial condensation, expanded to the tower operating pressure, and supplied as top feed to the tower. Typical process schemes of this type are disclosed in co-pending application Ser. Nos. 11/839,693; 12/869,007; and 12/869,139. These also require an additional rectification section in the demethanizer, plus a compressor to provide motive force for recycling the reflux stream to the demethanizer, again adding to both the capital cost and the operating cost of facilities using these processes.

However, there are many gas processing plants that have been built in the U.S. and other countries according to U.S. Pat. Nos. 4,157,904 and 4,278,457 (as well as other processes) that have no upper absorber section to provide additional rectification of the rising vapors and cannot be easily modified to add this feature. Also, these plants do not usually have surplus compression capacity to allow recycling a reflux stream. As a result, these plants are not as efficient when operated to recover $C_2$ components and heavier components from the gas (commonly referred to as "ethane recovery"), and are particularly inefficient when operated to recover only the $C_3$ components and heavier components from the gas (commonly referred to as "ethane rejection").

The present invention is a novel means of providing additional rectification (similar to what is used in co-pending application Ser. No. 12/869,139) that can be easily added to existing gas processing plants to increase the recovery of the desired $C_2$ components and/or $C_3$ components without requiring additional residue gas compression. The incremental value of this increased recovery is often substantial. For the Examples given later, the incremental income from the additional recovery capability over that of the prior art is in the range of US$ 590,000 to US$ 930,000 [€530,000 to €850,000] per year using an average incremental value US$ 0.10-0.69 per gallon [€24-165 per $m^3$] for hydrocarbon liquids compared to the corresponding hydrocarbon gases.

The present invention also combines what heretofore have been individual equipment items into a common housing, thereby reducing both the plot space requirements and the capital cost of the addition. Surprisingly, applicants have found that the more compact arrangement also significantly increases the product recovery at a given power consumption, thereby increasing the process efficiency and reducing the operating cost of the facility. In addition, the more compact arrangement also eliminates much of the piping used to interconnect the individual equipment items in traditional plant designs, further reducing capital cost and also eliminating the associated flanged piping connections. Since piping flanges are a potential leak source for hydrocarbons (which are volatile organic compounds, VOCs, that contribute to greenhouse gases and may also be precursors to atmospheric ozone formation), eliminating these flanges reduces the potential for atmospheric emissions that may damage the environment.

In accordance with the present invention, it has been found that $C_2$ recoveries in excess of 97% can be obtained. Similarly, in those instances where recovery of $C_2$ components is not desired, $C_3$ recoveries in excess of 99% can be maintained. The present invention, although applicable at lower pressures and warmer temperatures, is particularly advantageous when processing feed gases in the range of 400 to 1500 psia [2,758 to 10,342 kPa(a)] or higher under conditions requiring NGL recovery column overhead temperatures of −50° F. [−46° C.] or colder.

For a better understanding of the present invention, reference is made to the following examples and drawings. Referring to the drawings:

FIGS. 1 and 2 are flow diagrams of prior art natural gas processing plants in accordance with U.S. Pat. No. 4,157,904 or 4,278,457;

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the Système International d'Unités (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour.

DESCRIPTION OF THE PRIOR ART

Figure 1:
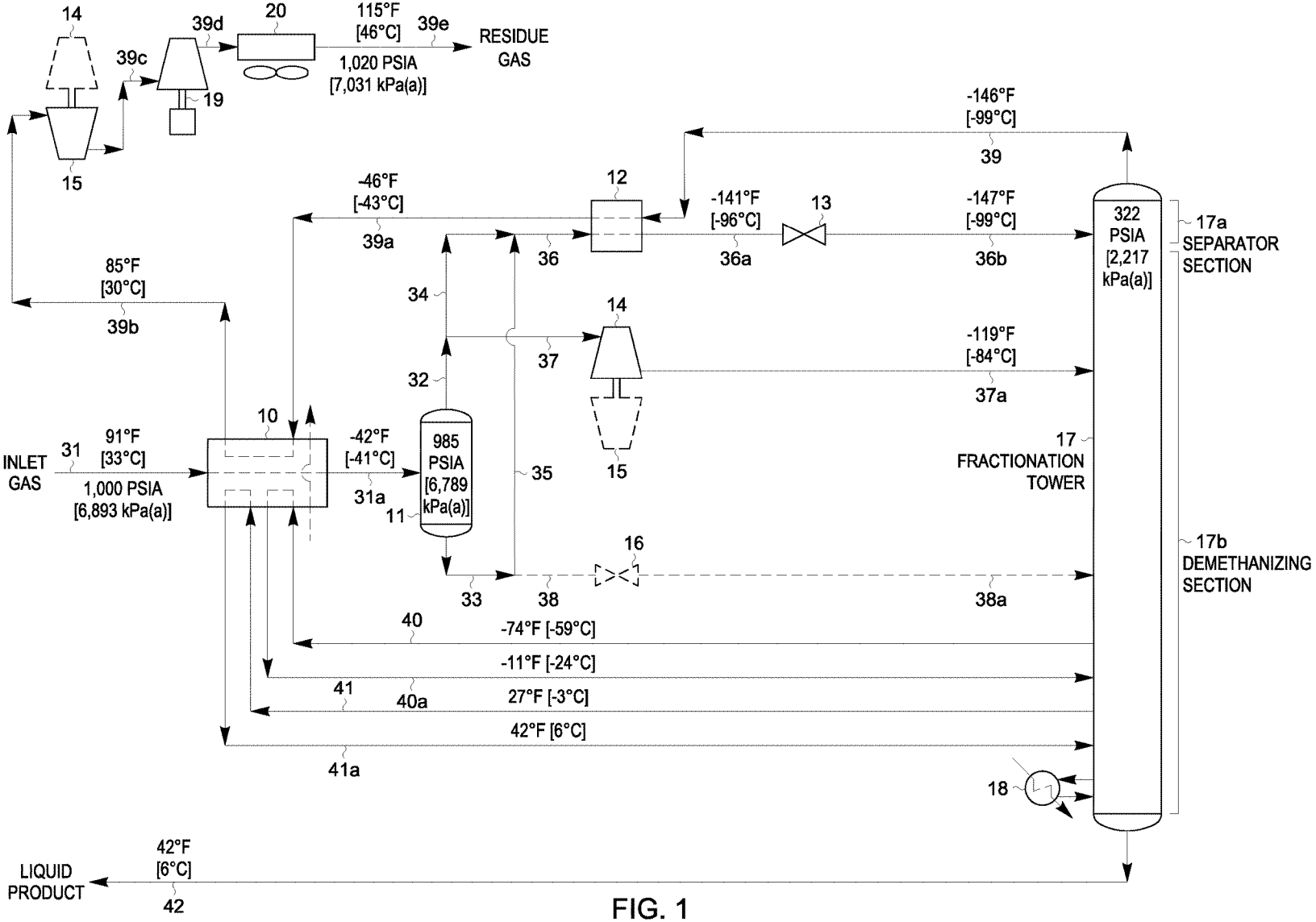
FIG. 1 (PRIOR ART)

FIG. 1 is a process flow diagram showing the design of a processing plant to recover $C_2$+ components from natural gas using prior art according to U.S. Pat. No. 4,157,904 or 4,278,457. In this simulation of the process, inlet gas enters the plant at 91° F. [33° C.] and 1,000 psia [6,893 kPa(a)] as stream 31. If the inlet gas contains a concentration of sulfur compounds which would prevent the product streams from meeting specifications, the sulfur compounds are removed by appropriate pretreatment of the feed gas (not illustrated). In addition, the feed stream is usually dehydrated to prevent hydrate (ice) formation under cryogenic conditions. Solid desiccant has typically been used for this purpose.

The feed stream 31 is cooled in heat exchanger 10 by heat exchange with cool residue gas (stream 39*a*), demethanizer reboiler liquids at 27° F. [−3° C.] (stream 41), and demethanizer side reboiler liquids at −74° F. [−59° C.] (stream 40). (In some cases, the use of one or more supplemental external refrigeration streams may be advantageous as shown by the dashed line.) Stream 31*a* then enters separator 11 at −42° F. [−41° C.] and 985 psia [6,789 kPa(a)] where the vapor (stream 32) is separated from the condensed liquid (stream 33).

The vapor (stream 32) from separator 11 is divided into two streams, 34 and 37. The liquid (stream 33) from separator 11 is optionally divided into two streams, 35 and 38. (Stream 35 may contain from 0% to 100% of the separator liquid in stream 33. If stream 35 contains any portion of the separator liquid, then the process of FIG. 1 is according to U.S. Pat. No. 4,157,904. Otherwise, the process of FIG. 1 is according to U.S. Pat. No. 4,278,457.) For the process illustrated in FIG. 1, stream 35 contains 100% of the total separator liquid. Stream 34, containing about 31% of the total separator vapor, is combined with stream 35 and the combined stream 36 passes through heat exchanger 12 in heat exchange relation with the cold residue gas (stream 39) where it is cooled to substantial condensation. The resulting substantially condensed stream 36*a* at −141° F. [−96° C.] is then flash expanded through expansion valve 13 to the operating pressure (approximately 322 psia [2,217 kPa(a)]) of fractionation tower 17. During expansion a portion of the stream is vaporized, resulting in cooling of the total stream. In the process illustrated in FIG. 1, the expanded stream 36*b* leaving expansion valve 13 reaches a temperature of −147° F. [−99° C.] and is supplied to separator section 17*a* in the upper region of fractionation tower 17. The liquids separated therein become the top feed to demethanizing section 17*b*.

The remaining 69% of the vapor from separator 11 (stream 37) enters a work expansion machine 14 in which mechanical energy is extracted from this portion of the high pressure feed. The machine 14 expands the vapor substantially isentropically to the tower operating pressure, with the work expansion cooling the expanded stream 37*a* to a temperature of approximately −119° F. [−84° C.]. The typical commercially available expanders are capable of recovering on the order of 80-85% of the work theoretically available in an ideal isentropic expansion. The work recovered is often used to drive a centrifugal compressor (such as item 15) that can be used to re-compress the residue gas (stream 39*b*), for example. The partially condensed expanded stream 37*a* is thereafter supplied as feed to fractionation tower 17 at an upper mid-column feed point. The remaining separator liquid in stream 38 (if any) is expanded to the operating pressure of fractionation tower 17 by expansion valve 16, cooling stream 38*a* before it is supplied to fractionation tower 17 at a lower mid-column feed point.

The demethanizer in tower 17 is a conventional distillation column containing a plurality of vertically spaced trays, one or more packed beds, or some combination of trays and packing. As is often the case in natural gas processing plants, the fractionation tower may consist of two sections. The upper section 17*a* is a separator wherein the partially vaporized top feed is divided into its respective vapor and liquid portions, and wherein the vapor rising from the lower distillation or demethanizing section 17*b* is combined with the vapor portion of the top feed to form the cold demethanizer overhead vapor (stream 39) which exits the top of the tower. The lower, demethanizing section 17*b* contains the trays and/or packing and provides the necessary contact between the liquids falling downward and the vapors rising upward. The demethanizing section 17*b* also includes reboilers (such as the reboiler and the side reboiler described previously and supplemental reboiler 18) which heat and vaporize a portion of the liquids flowing down the column to provide the stripping vapors which flow up the column to strip the liquid product, stream 42, of methane and lighter components.

The liquid product stream 42 exits the bottom of the tower at 42° F. [6° C.], based on a typical specification of a methane to ethane ratio of 0.020:1 on a molar basis in the bottom product. The residue gas (demethanizer overhead vapor stream 39) passes countercurrently to the incoming feed gas in heat exchanger 12 where it is heated from −146° F. [−99° C.] to −46° F. [−43° C.] (stream 39*a*) and in heat exchanger 10 where it is heated to 85° F. [30° C.] (stream 39*b*). The residue gas is then re-compressed in two stages. The first stage is compressor 15 driven by expansion machine 14. The second stage is compressor 19 driven by a supplemental power source which compresses the residue gas (stream 39*d*) to sales line pressure. After cooling to 115° F. [46° C.] in discharge cooler 20, the residue gas product (stream 39*e*) flows to the sales gas pipeline at 1,020 psia [7,031 kPa(a)], sufficient to meet line requirements (usually on the order of the inlet pressure).

A summary of stream flow rates and energy consumption for the process illustrated in FIG. 1 is set forth in the following table:

TABLE I (FIG. 1)
Stream Flow Summary - Lb. Moles/Hr [kg moles/Hr]

| Stream | Methane | Ethane | Propane | Butanes+ | Total |
|---|---|---|---|---|---|
| 31 | 19,183 | 1,853 | 560 | 199 | 21,961 |
| 32 | 18,236 | 1,593 | 407 | 100 | 20,491 |
| 33 | 947 | 260 | 153 | 99 | 1,470 |
| 34 | 5,609 | 490 | 125 | 31 | 6,303 |
| 36 | 6,556 | 750 | 278 | 130 | 7,773 |
| 37 | 12,627 | 1,103 | 282 | 69 | 14,188 |
| 39 | 19,149 | 146 | 7 | 0 | 19,382 |
| 42 | 34 | 1,707 | 553 | 199 | 2,579 |

Recoveries*

| | |
|---|---|
| Ethane | 92.14% |
| Propane | 98.75% |
| Butanes+ | 99.78% |

Power

| | | |
|---|---|---|
| Residue Gas Compression | 12,012 HP | [19,748 kW] |

*(Based on un-rounded flow rates)

Figure 2:
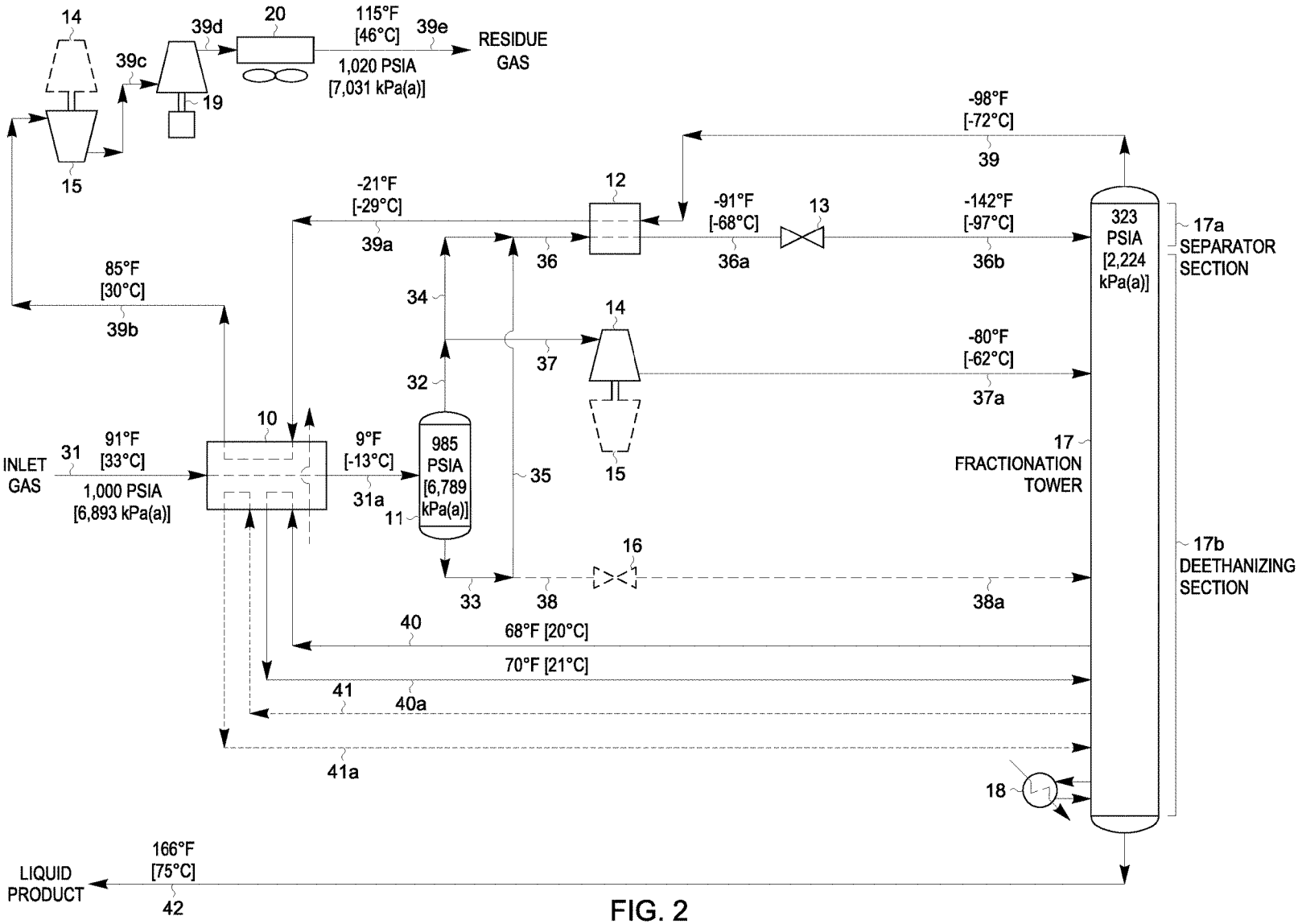
FIG. 2 (PRIOR ART)

FIG. 2 is a process flow diagram showing one manner in which the design of the processing plant in FIG. 1 can be adjusted to operate at a lower $C_2$ component recovery level. This is a common requirement when the relative values of natural gas and liquid hydrocarbons are variable, causing recovery of the $C_2$ components to be unprofitable at times. The process of FIG. 2 has been applied to the same feed gas composition and conditions as described previously for FIG. 1. However, in the simulation of the process of FIG. 2, the process operating conditions have been adjusted to reject nearly all of $C_2$ components to the residue gas rather than recovering them in the bottom liquid product from the fractionation tower.

In this simulation of the process, inlet gas enters the plant at 91° F. [33° C.] and 1,000 psia [6,893 kPa(a)] as stream 31 and is cooled in heat exchanger 10 by heat exchange with cool residue gas stream 39*a* and demethanizer side reboiler liquids at 68° F. [20° C.] (stream 40). (One consequence of operating the FIG. 2 process to reject nearly all of the $C_2$ components to the residue gas is that the temperatures of the liquids flowing down fractionation tower 17 are much warmer, to the point that side reboiler stream 40 is nearly as warm as the inlet gas and reboiler stream 41 can no longer be used to cool the inlet gas at all, so that nearly all of the column reboil heat must be supplied by supplemental reboiler 18.) Cooled stream 31*a* enters separator 11 at 9° F. [—13° C.] and 985 psia [6,789 kPa(a)] where the vapor (stream 32) is separated from any condensed liquid (stream 33). Under these conditions, however, no liquid is condensed.

The vapor (stream 32) from separator 11 is divided into two streams, 34 and 37, and any liquid (stream 33) is optionally divided into two streams, 35 and 38. For the process illustrated in FIG. 2, stream 35 would contain 100% of the total separator liquid if any was formed. Stream 34, containing about 29% of the total separator vapor, is combined with any liquid in stream 35 and the combined stream 36 passes through heat exchanger 12 in heat exchange relation with the cold residue gas (stream 39) where it is cooled to substantial condensation. The resulting substantially condensed stream 36*a* at −91° F. [−68° C.] is then flash expanded through expansion valve 13 to the operating pressure (approximately 323 psia [2,224 kPa(a)]) of fractionation tower 17. During expansion a portion of the stream is vaporized, resulting in cooling of the total stream. In the process illustrated in FIG. 2, the expanded stream 36*b* leaving expansion valve 13 reaches a temperature of −142° F. [−97° C.] and is supplied to fractionation tower 17 at the top feed point.

The remaining 71% of the vapor from separator 11 (stream 37) enters a work expansion machine 14 in which mechanical energy is extracted from this portion of the high pressure feed. The machine 14 expands the vapor substantially isentropically to the tower operating pressure, with the work expansion cooling the expanded stream 37*a* to a temperature of approximately −80° F. [−62° C.] before it is supplied as feed to fractionation tower 17 at an upper mid-column feed point. The remaining separator liquid in stream 38 (if any) is expanded to the operating pressure of fractionation tower 17 by expansion valve 16, cooling stream 38*a* before it is supplied to fractionation tower 17 at a lower mid-column feed point.

Note that when fractionation tower 17 is operated to reject the $C_2$ components to the residue gas product as shown in FIG. 2, the column is typically referred to as a deethanizer and its lower section 17*b* is called a deethanizing section. The liquid product stream 42 exits the bottom of deethanizer 17 at 166° F. [75° C.], based on a typical specification of an ethane to propane ratio of 0.020:1 on a molar basis in the bottom product. The residue gas (deethanizer overhead vapor stream 39) passes countercurrently to the incoming feed gas in heat exchanger 12 where it is heated from −98° F. [−72° C.] to −21° F. [−29° C.] (stream 39*a*) and in heat exchanger 10 where it is heated to 85° F. [30° C.] (stream 39*b*) as it provides cooling as previously described. The residue gas is then re-compressed in two stages, compressor 15 driven by expansion machine 14 and compressor 19 driven by a supplemental power source. After stream 39*d* is cooled to 115° F. [46° C.] in discharge cooler 20, the residue gas product (stream 39*e*) flows to the sales gas pipeline at 1,020 psia [7,031 kPa(a)].

A summary of stream flow rates and energy consumption for the process illustrated in FIG. 2 is set forth in the following table:

TABLE II (FIG. 2)
Stream Flow Summary - Lb. Moles/Hr [kg moles/Hr]

| Stream | Methane | Ethane | Propane | Butanes+ | Total |
|---|---|---|---|---|---|
| 31 | 19,183 | 1,853 | 560 | 199 | 21,961 |
| 32 | 19,183 | 1,853 | 560 | 199 | 21,961 |
| 33 | 0 | 0 | 0 | 0 | 0 |
| 34 | 5,467 | 528 | 160 | 57 | 6,259 |
| 36 | 5,467 | 528 | 160 | 57 | 6,259 |
| 37 | 13,716 | 1,325 | 400 | 142 | 15,702 |
| 39 | 19,183 | 1,843 | 40 | 2 | 21,234 |
| 42 | 0 | 10 | 520 | 197 | 727 |

Recoveries*

| | |
|---|---|
| Propane | 92.84% |
| Butanes+ | 98.90% |

Power

| | | |
|---|---|---|
| Residue Gas Compression | 12,012 HP | [19,748 kW] |

*(Based on un-rounded flow rates)

Figure 3:
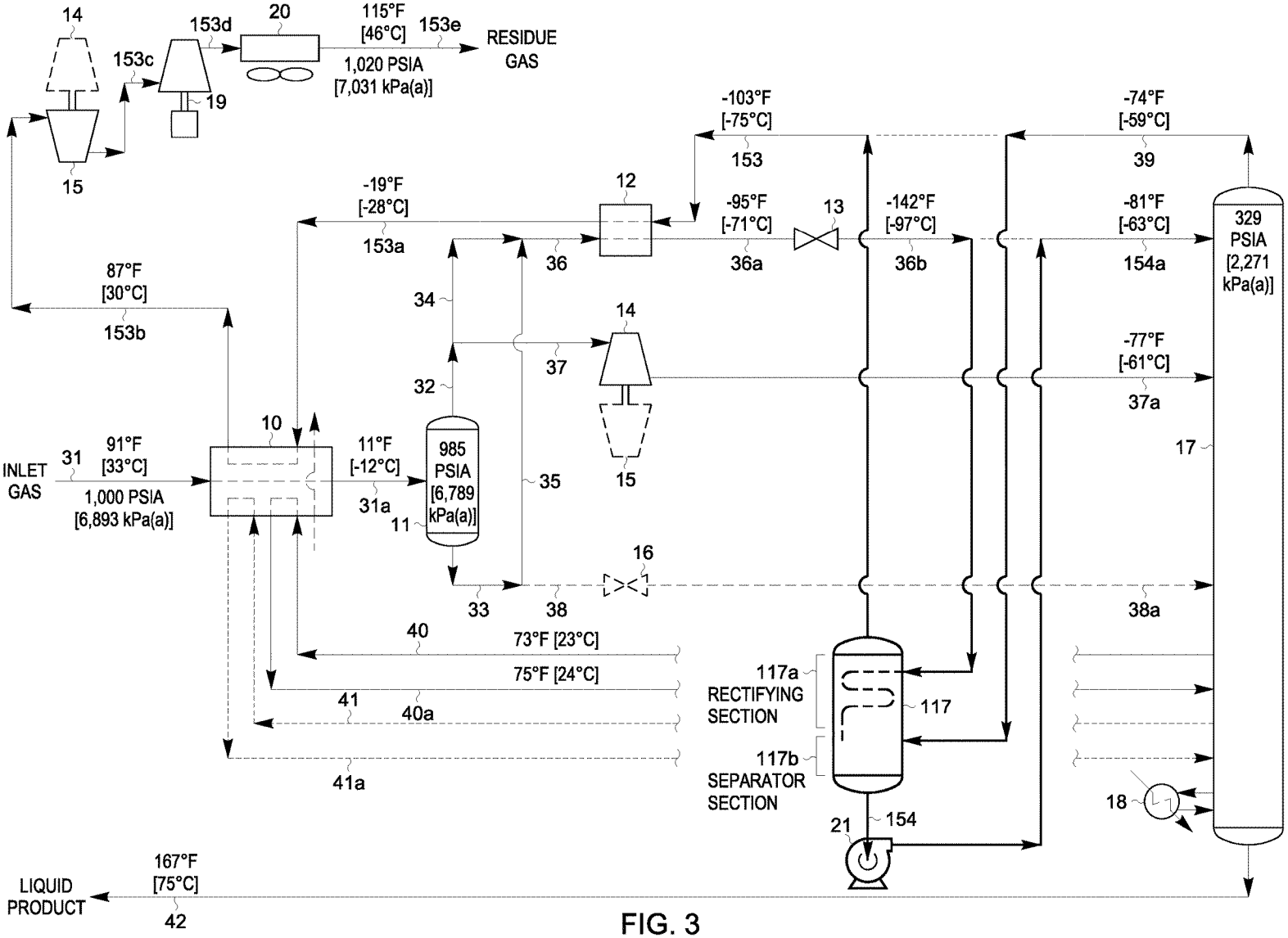
FIG. 3 (PRIOR ART)
FIGS. 3 and 4 are flow diagrams of natural gas processing plants adapted to use the process of co-pending application Ser. No. 14/462,056.

Co-pending application Ser. No. 14/462,056 describes one means of improving the performance of the FIG. 2 process when rejecting nearly all of $C_2$ components to the residue gas rather than recovering them in the bottom liquid product. FIG. 2 can be adapted to use this process as shown in FIG. 3. The operating conditions of the FIG. 3 process have been adjusted as shown to reduce the ethane content of the liquid product to the same level as that of the FIG. 2 process. The feed gas composition and conditions considered in the process presented in FIG. 3 are the same as those in FIG. 2. Accordingly, the FIG. 3 process can be compared with that of the FIG. 2 process.

Most of the process conditions shown for the FIG. 3 process are much the same as the corresponding process conditions for the FIG. 2 process. The main differences are the disposition of flash expanded substantially condensed stream 36*b* and column overhead vapor stream 39. In the FIG. 3 process, substantially condensed stream 36*a* is flash expanded through expansion valve 13 to slightly above the operating pressure (approximately 329 psia [2,271 kPa(a)]) of fractionation tower 17. During expansion a portion of the stream is vaporized, resulting in cooling of the total stream. In the process illustrated in FIG. 3, the expanded stream 36*b* leaving expansion valve 13 reaches a temperature of −142° F. [−97° C.] before it is directed into a heat and mass transfer means in rectifying section 117*a* of processing assembly 117. The heat and mass transfer means is configured to provide heat exchange between a combined vapor stream flowing upward through one pass of the heat and mass transfer means, and the flash expanded substantially condensed stream 36*b* flowing downward, so that the combined vapor stream is cooled while heating the expanded stream. As the combined vapor stream is cooled, a portion of it is condensed and falls downward while the remaining combined vapor stream continues flowing upward through the heat and mass transfer means. The heat and mass transfer means provides continuous contact between the condensed liquid and the combined vapor stream so that it also functions to provide mass transfer between the vapor and liquid phases, thereby providing rectification of the combined vapor stream. The condensed liquid from the bottom of the heat and mass transfer means is directed to separator section 117*b* of processing assembly 117.

The flash expanded stream 36*b* is further vaporized as it provides cooling and partial condensation of the combined vapor stream, and exits the heat and mass transfer means in rectifying section 117*a* at −83° F. [−64° C.]. The heated flash expanded stream discharges into separator section 117*b* of processing assembly 117 and is separated into its respective vapor and liquid phases. The vapor phase combines with overhead vapor stream 39 to form the combined vapor stream that enters the heat and mass transfer means in rectifying section 117*a* as previously described, and the liquid phase combines with the condensed liquid from the bottom of the heat and mass transfer means to form combined liquid stream 154. Combined liquid stream 154 leaves the bottom of processing assembly 117 and is pumped to higher pressure by pump 21 so that stream 154*a* at −81° F. [−63° C.] can enter fractionation column 17 at the top feed point. The vapor remaining from the cooled combined vapor stream leaves the heat and mass transfer means in rectifying section 117*a* of processing assembly 117 at −103° F. [−75° C.] as cold residue gas stream 153, which is then heated and compressed as described previously for stream 39 in the FIG. 2 process.

A summary of stream flow rates and energy consumption for the process illustrated in FIG. 3 is set forth in the following table:

TABLE III (FIG. 3)
Stream Flow Summary - Lb. Moles/Hr [kg moles/Hr]

| Stream | Methane | Ethane | Propane | Butanes+ | Total |
|---|---|---|---|---|---|
| 31 | 19,183 | 1,853 | 560 | 199 | 21,961 |
| 32 | 19,183 | 1,853 | 560 | 199 | 21,961 |
| 33 | 0 | 0 | 0 | 0 | 0 |
| 34 | 5,659 | 547 | 165 | 59 | 6,478 |
| 36 | 5,659 | 547 | 165 | 59 | 6,478 |
| 37 | 13,524 | 1,306 | 395 | 140 | 15,483 |
| 39 | 14,278 | 2,573 | 86 | 4 | 17,077 |
| 154 | 754 | 1,278 | 242 | 63 | 2,355 |
| 153 | 19,183 | 1,842 | 9 | 0 | 21,200 |
| 42 | 0 | 11 | 551 | 199 | 761 |

Recoveries*

| | |
|---|---|
| Propane | 98.46% |
| Butanes+ | 99.98% |

Power

| | | |
|---|---|---|
| Residue Gas Compression | 12,012 HP | [19,748 kW] |

*(Based on un-rounded flow rates)

A comparison of Tables II and III shows that, compared to the FIG. 2 process, the FIG. 3 process improves propane recovery from 92.84% to 98.46% and butane+recovery from 98.90% to 99.98%. Comparison of Tables II and III further shows that these increased product yields were achieved without using additional power.

Figure 4:
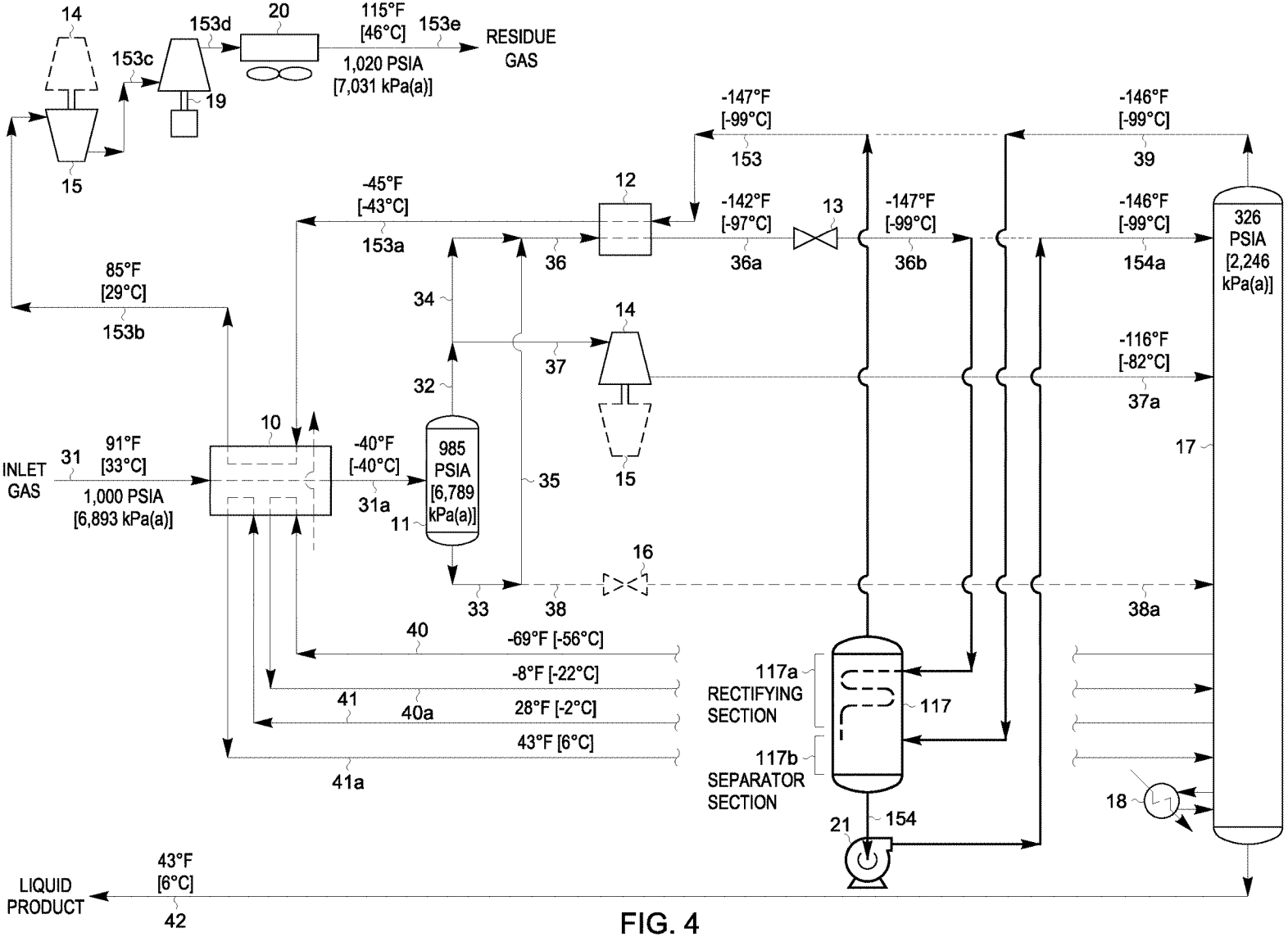
FIG. 4 (PRIOR ART)

The process of co-pending application Ser. No. 14/462,056 can also be operated to recover the maximum amount of $C_2$ components in the liquid product. The operating conditions of the FIG. 3 process can be altered as illustrated in FIG. 4 to increase the ethane content of the liquid product to the essentially the same level as that of the FIG. 1 process. The feed gas composition and conditions considered in the process presented in FIG. 4 are the same as those in FIG. 1. Accordingly, the FIG. 4 process can be compared with that of the FIG. 1 process.

Most of the process conditions shown for the FIG. 4 process are much the same as the corresponding process conditions for the FIG. 1 process. The main differences are again the disposition of flash expanded substantially condensed stream 36*b* and column overhead vapor stream 39. In the FIG. 4 process, substantially condensed stream 36*a* is flash expanded through expansion valve 13 to slightly above the operating pressure (approximately 326 psia [2,246 kPa (a)]) of fractionation tower 17. During expansion a portion of the stream is vaporized, resulting in cooling of the total stream. In the process illustrated in FIG. 4, the expanded stream 36*b* leaving expansion valve 13 reaches a temperature of −147° F. [−99° C.] before it is directed into the heat and mass transfer means in rectifying section 117*a* of processing assembly 117.

The flash expanded stream 36*b* is further vaporized as it provides cooling and partial condensation of the combined vapor stream, and exits the heat and mass transfer means in rectifying section 117*a* at −147° F. [−99° C.]. (Note that the temperature of stream 36*b* does not change as it is heated, due to the pressure drop through the heat and mass transfer means and the resulting vaporization of some of the liquid methane contained in the stream.) The heated flash expanded stream discharges into separator section 117*b* of processing assembly 117 and is separated into its respective vapor and liquid phases. The vapor phase combines with overhead vapor stream 39 to form the combined vapor stream that enters the heat and mass transfer means in rectifying section 117*a* as previously described, and the liquid phase combines with the condensed liquid from the bottom of the heat and mass transfer means to form combined liquid stream 154. Combined liquid stream 154 leaves the bottom of processing assembly 117 and is pumped to higher pressure by pump 21 so that stream 154*a* at −146° F. [−99° C.] can enter fractionation column 17 at the top feed point. The vapor remaining from the cooled combined vapor stream leaves the heat and mass transfer means in rectifying section 117*a* of processing assembly 117 at −147° F. [−99° C.] as cold residue gas stream 153, which is then heated and compressed as described previously for stream 39 in the FIG. 1 process.

A summary of stream flow rates and energy consumption for the process illustrated in FIG. 4 is set forth in the following table:

TABLE IV (FIG. 4)
Stream Flow Summary - Lb. Moles/Hr [kg moles/Hr]

| Stream | Methane | Ethane | Propane | Butanes+ | Total |
|---|---|---|---|---|---|
| 31 | 19,183 | 1,853 | 560 | 199 | 21,961 |
| 32 | 18,361 | 1,620 | 419 | 105 | 20,661 |
| 33 | 822 | 233 | 141 | 94 | 1,300 |
| 34 | 5,640 | 498 | 129 | 32 | 6,346 |
| 36 | 6,462 | 731 | 270 | 126 | 7,646 |
| 37 | 12,721 | 1,122 | 290 | 73 | 14,315 |
| 39 | 18,937 | 145 | 7 | 0 | 19,157 |
| 154 | 6,250 | 732 | 270 | 126 | 7,423 |
| 153 | 19,149 | 144 | 7 | 0 | 19,380 |
| 42 | 34 | 1,709 | 553 | 199 | 2,581 |

Recoveries*

| | |
|---|---|
| Ethane | 92.21% |
| Propane | 98.77% |
| Butanes+ | 99.79% |

Power

| | | |
|---|---|---|
| Residue Gas Compression | 12,010 HP | [19,744 kW] |

*(Based on un-rounded flow rates)

A comparison of Tables I and IV shows that, compared to the FIG. 1 process, the FIG. 4 process does not offer any significant improvement when operated to recover the maximum amount of $C_2$ components. To understand this, it is instructive to compare the FIG. 1 process (operating to recover the maximum amount of $C_2$ components) with the FIG. 2 process (operating to recover the minimum amount of $C_2$ components), particularly with respect to the temperatures of the top feed (stream 36*b*) and the overhead vapor (stream 39) of fractionation column 17.

When the processing plant is operated as shown in FIG. 2 to reject the $C_2$ components to the residue gas (overhead vapor stream 39), the overhead temperature of fractionation column 17 is relatively warm, −98° F. [−72° C.], because the $C_2$ components and heavier components in stream 39 raise its dewpoint temperature. This results in a large temperature difference between the column overhead vapor (stream 39) and the top column feed (stream 36*b*), which enters the column at −142° F. [−97° C.]. This differential provides the temperature driving force that allows the heat and mass transfer means in rectifying section 117*a* of processing assembly 117 added in the FIG. 3 process to condense the heavier components in the combined vapor stream rising from separator section 117*b*, thereby rectifying the vapor stream and capturing the desired $C_3$+ components in stream 154 so that they can be recovered in bottom product stream 42 from column 17.

Contrast this now with streams 36*b* and 39 of FIG. 1 when the processing plant is operated to recover the $C_2$ components. The overhead temperature of fractionation column 17 is much colder because the dewpoint temperature of stream 39 is so much lower. Consequently, the column overhead temperature (−146° F. [−99° C.] for stream 39) is almost the same as the top column feed temperature (−147° F. [−99° C.] for stream 36*b*), meaning that there is essentially no temperature driving force for the heat and mass transfer means in rectifying section 117*a* of processing assembly 117 added in the FIG. 4 process. Without any driving force, there is no condensation of the heavier components from the combined vapor stream rising from separator section 117*b*, so no rectification can take place and there is no improvement in the recovery of $C_2$ components between the FIG. 1 process and the FIG. 4 process. The process of co-pending application Ser. No. 14/462,056 has no means for creating any temperature driving force for rectifying section 117*a* when the operating conditions of the processing plant are adjusted to recover the maximum amount of $C_2$ components.

DESCRIPTION OF THE INVENTION

Example 1

Figure 5:
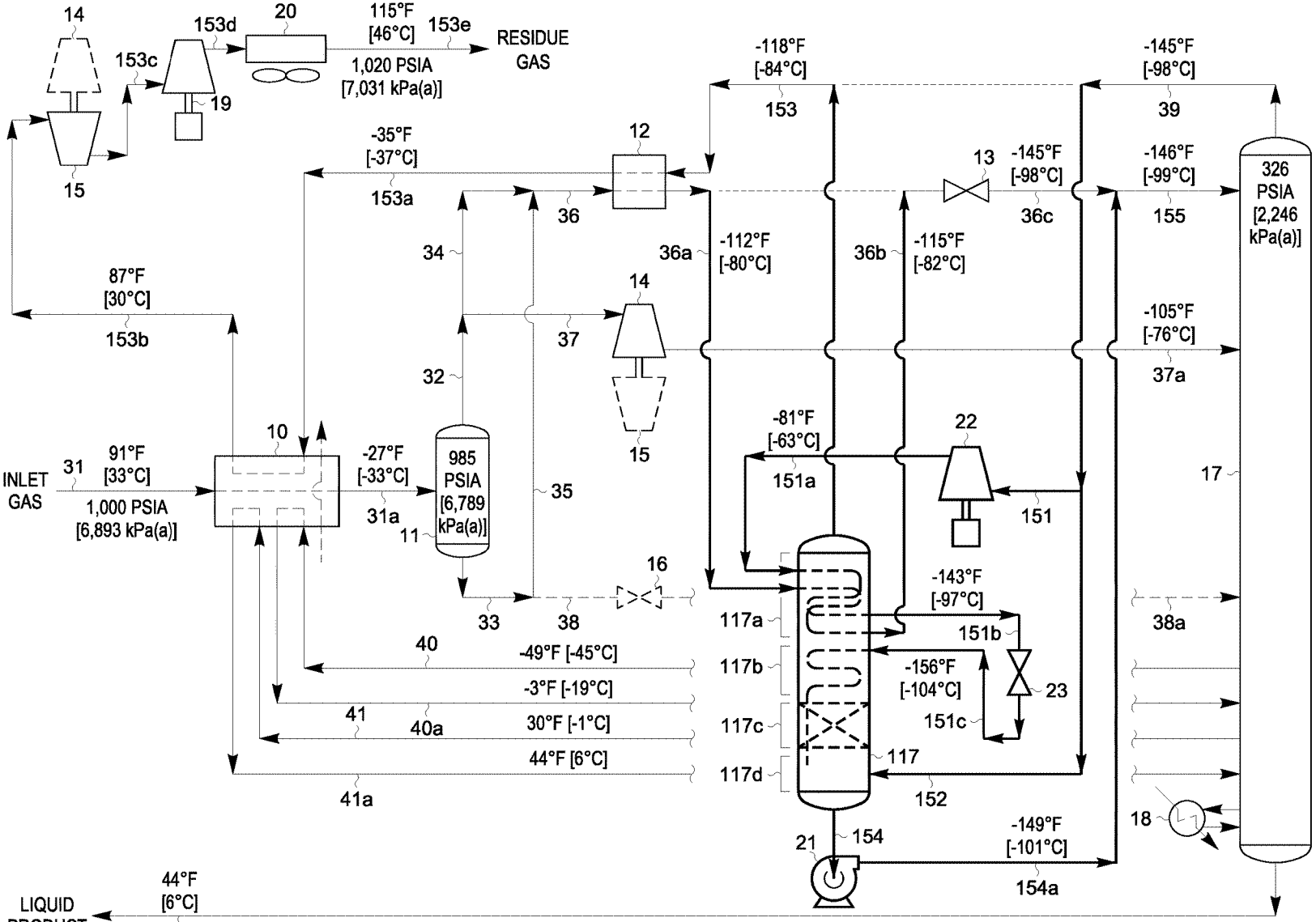
FIG. 5 is a flow diagram of a natural gas processing plant adapted to use the present invention.

In those cases where it is desirable to maximize the recovery of $C_2$ components in the liquid product (as in the FIG. 1 prior art process described previously, for instance), the present invention offers significant efficiency advantages over the prior art processes depicted in FIGS. 1 and 4. FIG. 5 illustrates a flow diagram of the FIG. 1 prior art process that has been adapted to use the present invention. The operating conditions of the FIG. 5 process have been adjusted as shown to increase the ethane content of the liquid product above the level that is possible with the FIGS. 1 and 4 prior art processes. The feed gas composition and conditions considered in the process presented in FIG. 5 are the same as those in FIGS. 1 and 4. Accordingly, the FIG. 5 process can be compared with that of the FIGS. 1 and 4 processes to illustrate the advantages of the present invention.

Most of the process conditions shown for the FIG. 5 process are much the same as the corresponding process conditions for the FIG. 1 process. The main difference is the disposition of substantially condensed stream 36*a* and column overhead vapor stream 39. In the FIG. 5 process, column overhead vapor stream 39 is divided into two streams, stream 151 and stream 152, whereupon stream 151 is compressed from the operating pressure (approximately 326 psia [2,246 kPa(a)]) of fractionation tower 17 to approximately 545 psia [3,756 kPa(a)] by reflux compressor 22. Compressed stream 151*a* at −81° F. [−63° C.] and substantially condensed stream 36*a* at −112° F. [−80° C.] are then directed into a heat exchange means in cooling section 117*a* of processing assembly 117. This heat exchange means may be comprised of a fin and tube type heat exchanger, a plate type heat exchanger, a brazed aluminum type heat exchanger, or other type of heat transfer device, including multi-pass and/or multi-service heat exchangers. The heat exchange means is configured to provide heat exchange between stream 151*a* flowing through one pass of the heat exchange means, substantially condensed stream 36*a* flowing through another pass of the heat exchange means, and a further rectified vapor stream arising from rectifying section 117*b* of processing assembly 117, so that stream 151*a* is cooled to substantial condensation (stream 151*b*) and stream 36*a* is further cooled (stream 36*b*) while heating the further rectified vapor stream.

Substantially condensed stream 151*b* at −143° F. [−97° C.] is then flash expanded through expansion valve 23 to slightly above the operating pressure of fractionation tower 17. During expansion a portion of the stream may be vaporized, resulting in cooling of the total stream. In the process illustrated in FIG. 5, the expanded stream 151*c* leaving expansion valve 23 reaches a temperature of −156° F. [−104° C.] before it is directed into a heat and mass transfer means in rectifying section 117*b* of processing assembly 117. This heat and mass transfer means may also be comprised of a fin and tube type heat exchanger, a plate type heat exchanger, a brazed aluminum type heat exchanger, or other type of heat transfer device, including multi-pass and/or multi-service heat exchangers. The heat and mass transfer means is configured to provide heat exchange between a partially rectified vapor stream arising from absorbing section 117*c* of processing assembly 117 that is flowing upward through one pass of the heat and mass transfer means, and the flash expanded substantially condensed stream 151*c* flowing downward, so that the partially rectified vapor stream is cooled while heating the expanded stream. As the partially rectified vapor stream is cooled, a portion of it is condensed and falls downward while the remaining vapor continues flowing upward through the heat and mass transfer means. The heat and mass transfer means provides continuous contact between the condensed liquid and the partially rectified vapor stream so that it also functions to provide mass transfer between the vapor and liquid phases, thereby providing further rectification of the partially rectified vapor stream to form the further rectified vapor stream. This further rectified vapor stream arising from the heat and mass transfer means is then directed to cooling section 117*a* of processing assembly 117. The condensed liquid from the bottom of the heat and mass transfer means is directed to absorbing section 117*c* of processing assembly 117.

The flash expanded stream 151*c* is further vaporized as it provides cooling and partial condensation of the partially rectified vapor stream, and exits the heat and mass transfer means in rectifying section 117*b* at −155° F. [−104° C.]. The heated flash expanded stream discharges into separator section 117*d* of processing assembly 117 and is separated into its respective vapor and liquid phases. The vapor phase combines with the remaining portion (stream 152) of overhead vapor stream 39 to form a combined vapor stream that enters a mass transfer means in absorbing section 117*c* of processing assembly 117. This mass transfer means may consist of a plurality of vertically spaced trays, one or more packed beds, or some combination of trays and packing, but could also be comprised of a non-heat transfer zone in a fin and tube type heat exchanger, a plate type heat exchanger, a brazed aluminum type heat exchanger, or other type of heat transfer device, including multi-pass and/or multi-service heat exchangers. The mass transfer means is configured to provide contact between the cold condensed liquid leaving the bottom of the heat and mass transfer means in rectifying section 117*b* and the combined vapor stream arising from separator section 117*d*. As the combined vapor stream rises upward through absorbing section 117*c*, it is contacted with the cold liquid falling downward to condense and absorb $C_2$ components, $C_3$ components, and heavier components from the combined vapor stream. The resulting partially rectified vapor stream is then directed to the heat and mass transfer means in rectifying section 117*b* of processing assembly 117 for further rectification as previously described.

The liquid phase (if any) from the heated flash expanded stream leaving rectifying section 117*b* of processing assembly 117 that is separated in separator section 117*d* combines with the distillation liquid leaving the bottom of the mass transfer means in absorbing section 117*c* of processing assembly 117 to form combined liquid stream 154. Combined liquid stream 154 leaves the bottom of processing assembly 117 and is pumped to higher pressure by pump 21 (stream 154*a* at −149° F. [−101° C.]). Further cooled stream 36*b* at −115° F. [−82° C.] is flash expanded through expansion valve 13 to the operating pressure of fractionation tower 17. During expansion a portion of the stream may be vaporized, resulting in cooling of the total stream to −145° F. [−98° C.]. Flash expanded stream 36*c* then joins with pumped stream 154*a* to form combined feed stream 155, which then enters fractionation column 17 at the top feed point at −146° F. [−99° C.].

The further rectified vapor stream leaves the heat and mass transfer means in rectifying section 117*b* of processing assembly 117 at −154° F. [−103° C.] and enters the heat exchange means in cooling section 117*a* of processing assembly 117. The vapor is heated to −118° F. [−84° C.] as it provides cooling to stream 151*a* as described previously. The heated vapor is then discharged from processing assembly 117 as cool residue gas stream 153, which is heated and compressed as described previously for stream 39 in the FIG. 1 process.

A summary of stream flow rates and energy consumption for the process illustrated in FIG. 5 is set forth in the following table:

TABLE V (FIG. 5)
Stream Flow Summary - Lb. Moles/Hr [kg moles/Hr]

| Stream | Methane | Ethane | Propane | Butanes+ | Total |
|---|---|---|---|---|---|
| 31 | 19,183 | 1,853 | 560 | 199 | 21,961 |
| 32 | 18,912 | 1,762 | 495 | 141 | 21,473 |
| 33 | 271 | 91 | 65 | 58 | 488 |
| 34 | 5,174 | 482 | 135 | 39 | 5,875 |
| 36 | 5,445 | 573 | 200 | 97 | 6,363 |
| 37 | 13,738 | 1,280 | 360 | 102 | 15,598 |
| 39 | 20,644 | 183 | 7 | 0 | 20,956 |
| 151 | 2,890 | 26 | 1 | 0 | 2,934 |
| 152 | 17,754 | 157 | 6 | 0 | 18,022 |
| 154 | 1,497 | 137 | 7 | 0 | 1,663 |
| 155 | 6,942 | 710 | 207 | 97 | 8,026 |
| 153 | 19,147 | 46 | 0 | 0 | 19,293 |
| 42 | 36 | 1,807 | 560 | 199 | 2,668 |

Recoveries*

| | |
|---|---|
| Ethane | 97.53% |
| Propane | 100.00% |
| Butanes+ | 100.00% |

Power

| | | |
|---|---|---|
| Residue Gas Compression | 11,550 HP | [18,988 kW] |
| Reflux Compression | 455 HP | [748 kW] |
| Total Compression | 12,005 HP | [19,736 kW] |

*(Based on un-rounded flow rates)

A comparison of Tables I and V shows that, compared to the prior art of FIG. 1, the present invention improves ethane recovery from 92.14% to 97.53%, propane recovery from 98.75% to 100.00%, and butane+recovery from 99.78% to 100.00%. A comparison of Tables IV and V shows similar improvements for the present invention over the prior art of FIG. 4. The economic impact of these improved recoveries is significant. Using an average incremental value $ 0.10/gallon [€23.6/m$^3$] for hydrocarbon liquids compared to the corresponding hydrocarbon gases, the improved recoveries represent more than US$ 930,000 [€850,000] of additional annual revenue for the plant operator. Comparison of Tables I, IV, and V further shows that these increased product yields were achieved using essentially the same power as the prior art. In terms of the recovery efficiency (defined by the quantity of $C_2$ components and heavier components recovered per unit of power), the present invention represents more than a 4% improvement over the prior art of the FIGS. 1 and 4 processes.

The dramatic improvement in recovery efficiency provided by the present invention over that of the prior art of the FIG. 1 process is primarily due to the additional cooling of the column overhead vapor provided by flash expanded stream 151*c* in rectifying section 117*b* of processing assembly 117. The prior art of the FIG. 1 process has only the flash expanded stream 36*b* at −147° F. [−99° C.] to cool the column vapor, limiting the overhead temperature of column 17 to this value or warmer. This results in significant amounts of the desired $C_2$ components and heavier components leaving column 17 in overhead vapor stream 39 rather than being recovered in bottom liquid product stream 42. Contrast this to the significantly colder −156° F. [−104° C.] temperature of stream 151*c* in the FIG. 5 embodiment of the present invention, which is thereby able to condense most of the desired $C_2$ components and heavier components from column overhead vapor stream 39. Note that the concentration of $C_2$ components in stream 39 (0.87 mol %) of the FIG. 5 embodiment of the present invention (which is about the same as the concentration of $C_2$ components in stream 39 of the prior art process in FIG. 1) is reduced to 0.24 mol % in stream 153 leaving processing assembly 117 by the additional cooling afforded by stream 151*c* of the present invention.

An additional advantage of the present invention over that of the prior art of the FIG. 1 process is the indirect cooling of the column vapor provided by flash expanded stream 151*c* in rectifying section 117*b* of processing assembly 117, rather than the direct-contact cooling that characterizes stream 36*b* in the prior art process of FIG. 1. Although stream 36*b* is relatively cold, it is not an ideal reflux stream because it contains significant concentrations of the $C_2$ components and $C_3$+ components that column 17 is supposed to capture, resulting in losses of these desirable components due to equilibrium effects at the top of column 17 for the prior art process of FIG. 1. For the FIG. 5 embodiment of the present invention, however, there are no equilibrium effects to overcome because there is no direct contact between flash expanded stream 151*c* and the partially rectified vapor stream that is further rectified in rectifying section 117*b*.

The present invention also benefits from the further cooling of substantially condensed stream 36*a* in the heat exchange means in cooling section 117*a* of processing assembly 117 before the stream is flash expanded through expansion valve 13. The additional cooling means there is less vaporization during the flash expansion, meaning that there is more liquid in stream 36*c* to rectify the distillation vapor in the upper section of column 17, thereby reducing the amount of rectification required in rectifying section 117*b* and absorbing section 117*c* of processing assembly 117.

The present invention has the further advantage over that of the prior art of the FIG. 1 process of using the heat and mass transfer means in rectifying section 117*b* to simultaneously cool the partially rectified vapor stream and condense the heavier hydrocarbon components from it, providing more efficient rectification than using reflux in a conventional distillation column. As a result, more of the $C_2$ components and heavier hydrocarbon components can be removed from the partially rectified vapor stream using the refrigeration available in expanded stream 151*c* than is possible using conventional mass transfer equipment and conventional heat transfer equipment. The rectification provided by the heat and mass transfer means in rectifying section 117*b* is further enhanced by the partial rectification accomplished by the mass transfer means in absorbing section 117*c* of processing assembly 117. The combined vapor stream from separator section 117*d* is contacted by the condensed liquid leaving the bottom of the heat and mass transfer means in rectifying section 117*b*, thereby condensing and absorbing some of the $C_2$ components and nearly all of the $C_3$+ components in the combined vapor stream to reduce the quantity that must be condensed and captured in rectifying section 117*b*.

The present invention offers two other advantages over the prior art in addition to the increase in processing efficiency. First, the compact arrangement of processing assembly 117 of the present invention replaces two separate equipment items in the prior art of co-pending application Ser. No. 12/869,139 (the third pass in heat exchanger 12 and the upper absorbing section in the top of distillation column 17 in FIG. 2 of application Ser. No. 12/869,139) with a single equipment item (processing assembly 117 in FIG. 5 of the present invention). This reduces the plot space requirements and eliminates some of the interconnecting piping, reducing the capital cost of modifying a process plant to use the present invention. Second, reduction of the amount of interconnecting piping means that a processing plant modified to use the present invention has fewer flanged connections compared to the prior art of co-pending application Ser. No. 12/869,139, reducing the number of potential leak sources in the plant. Hydrocarbons are volatile organic compounds (VOCs), some of which are classified as greenhouse gases and some of which may be precursors to atmospheric ozone formation, which means the present invention reduces the potential for atmospheric releases that may damage the environment.

One additional advantage of the present invention is how easily it can be incorporated into an existing gas processing plant to effect the superior performance described above. As shown in FIG. 5, only three connections (commonly referred to as "tie-ins") to the existing plant are needed: for substantially condensed stream 36*a* (represented by the dashed line between stream 36*a* and stream 36*b* that is removed from service), for column overhead vapor stream 39 (represented by the dashed line between stream 39 and stream 153 that is removed from service), and for flash expanded substantially condensed stream 36*c* (to connect with stream 154*a* to form combined feed stream 155). The existing plant can continue to operate while the new processing assembly 117 is installed near fractionation tower 17, with just a short plant shutdown when installation is complete to make the new tie-ins. The plant can then be restarted, with all of the existing equipment remaining in service and operating exactly as before, except that the product recovery is now higher with no increase in the total compression power.

Although the prior art of the FIG. 4 process can also be easily incorporated into an existing gas processing plant, it cannot provide the same improvement in recovery efficiency that the present invention does. There are two primary reasons for this. The first is the lack of additional cooling for the column vapor, since the prior art of the FIG. 4 process is also limited by the temperature of flash expanded stream 36 as was the case for the prior art of the FIG. 1 process. The second is that all of the rectification in processing assembly 117 of the FIG. 4 prior art process must be provided by its rectifying section 117*a*, because it lacks the absorbing section 117*c* in processing assembly 117 of the FIG. 5 embodiment of the present invention which provides partial rectification of the column vapor and reduces the load on its rectifying section 117*b*.

Example 2

Figure 8:
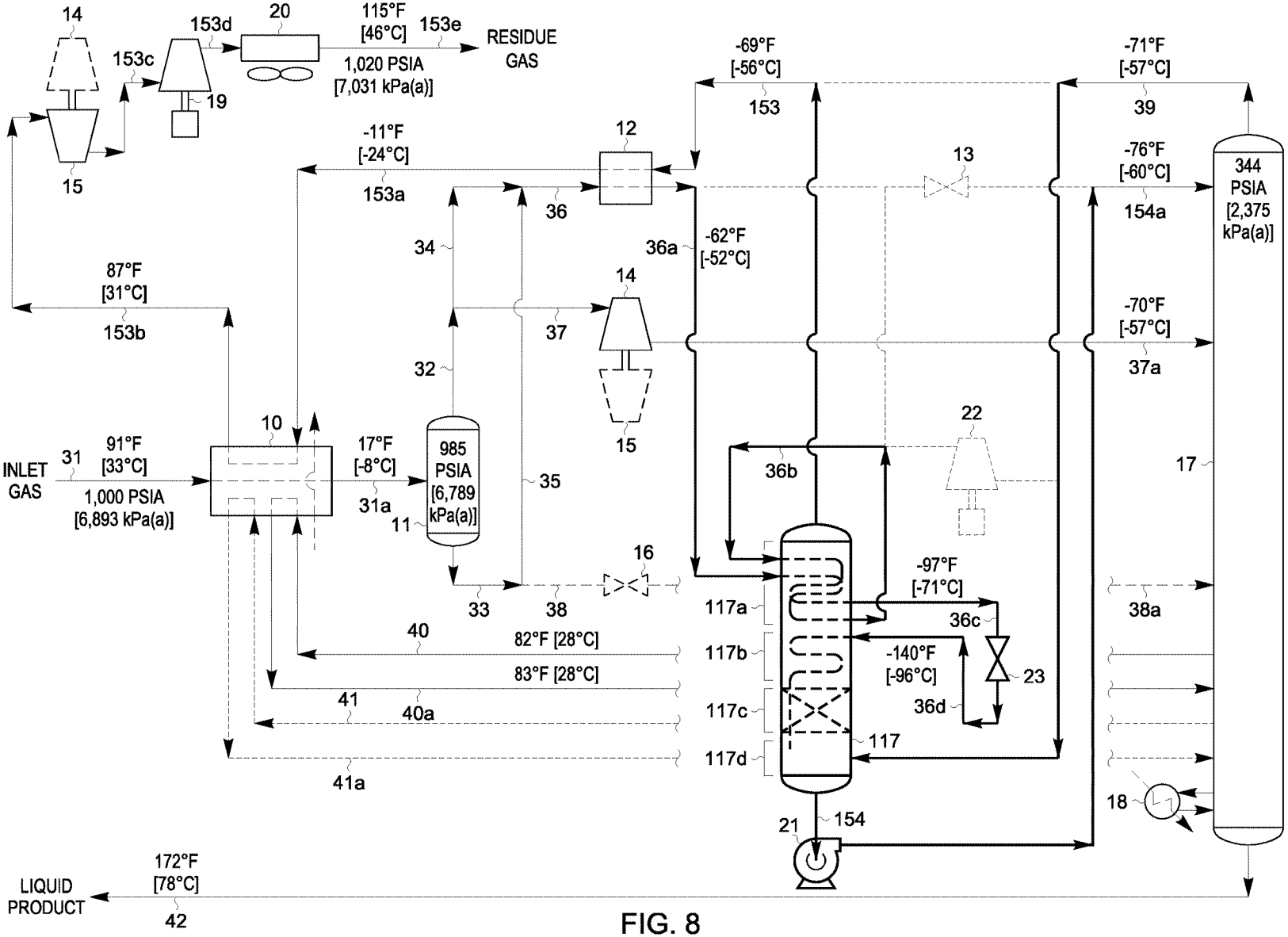

The present invention also offers advantages when product economics favor rejecting the $C_2$ components to the residue gas product. The present invention can be easily reconfigured to operate in a manner similar to that of co-pending application Ser. No. 14/462,056 as shown in FIG. 8. The operating conditions of the FIG. 5 embodiment of the present invention can be altered as illustrated in FIG. 8 to reduce the ethane content of the liquid product to the same level as that of the FIG. 3 prior art process. The feed gas composition and conditions considered in the process presented in FIG. 8 are the same as those in FIG. 3. Accordingly, the FIG. 8 process can be compared with that of the FIG. 3 process to further illustrate the advantages of the present invention.

When operating the present invention in this manner, many of the process conditions shown for the FIG. 8 process are much the same as the corresponding process conditions for the FIG. 3 process, although most of the process configuration is like the FIG. 5 embodiment of the present invention. The main difference relative to the FIG. 5 embodiment is that the flash expanded stream 36*d* directed to the heat and mass transfer means in rectifying section 117*b* of processing assembly 117 for FIG. 8 originates from cooled combined stream 36*a*, rather than from column overhead vapor stream 39 as in FIG. 5. As such, reflux compressor 22 is not needed and can be taken out of service (as indicated by the dashed lines), reducing the power requirements when operating in this manner.

For the operating conditions shown in FIG. 8, combined stream 36 is cooled to −62° F. [−52° C.] in heat exchanger 12 by heat exchange with cool residue gas stream 153. The partially condensed combined stream 36*a* is directed to the heat exchange means in cooling section 117*a* in processing assembly 117 (flowing through two passes of the heat exchange means in series via conduit 36*b*) where it is further cooled to substantial condensation (stream 36*c*) while heating the further rectified vapor stream.

Substantially condensed stream 36*c* at −97° F. [−71° C.] is flash expanded through expansion valve 23 to slightly above the operating pressure (approximately 344 psia [2,375 kPa(a)]) of fractionation tower 17. During expansion a portion of the stream may be vaporized, resulting in cooling of the total stream. In the process illustrated in FIG. 8, the expanded stream 36*d* leaving expansion valve 23 reaches a temperature of −140° F. [−96° C.] before it is directed into the heat and mass transfer means in rectifying section 117*b* of processing assembly 117.

The flash expanded stream 36*d* is further vaporized as it provides cooling and partial condensation of the partially rectified vapor stream, and exits the heat and mass transfer means in rectifying section 117*b* at −83° F. [−64° C.]. The heated flash expanded stream discharges into separator section 117*d* of processing assembly 117 and is separated into its respective vapor and liquid phases. The vapor phase combines with overhead vapor stream 39 to form the combined vapor stream that enters the mass transfer means in absorbing section 117*c* of processing assembly 117.

The liquid phase (if any) from the heated flash expanded stream leaving rectifying section 117*b* of processing assembly 117 that is separated in separator section 117*d* combines with the distillation liquid leaving the bottom of the mass transfer means in absorbing section 117*c* of processing assembly 117 to form combined liquid stream 154. Combined liquid stream 154 leaves the bottom of processing assembly 117 and is pumped to higher pressure by pump 21 so that stream 154*a* at −76° F. [−60° C.] can enter fractionation column 17 at the top feed point.

The further rectified vapor stream leaves the heat and mass transfer means in rectifying section 117*b* of processing assembly 117 at −103° F. [−75° C.] and enters the heat exchange means in cooling section 117*a*. The vapor is heated to −69° F. [−56° C.] as it provides cooling to streams 36*a* and 36*b* as described previously. The heated vapor is then discharged from processing assembly 117 as cool residue gas stream 153, which is heated and compressed as described previously for stream 39 in the FIG. 2 process.

A summary of stream flow rates and energy consumption for the process illustrated in FIG. 8 is set forth in the following table:

TABLE VI (FIG. 8)
Stream Flow Summary - Lb. Moles/Hr [kg moles/Hr]

| Stream | Methane | Ethane | Propane | Butanes+ | Total |
|---|---|---|---|---|---|
| 31 | 19,183 | 1,853 | 560 | 199 | 21,961 |
| 32 | 19,183 | 1,853 | 560 | 199 | 21,961 |
| 33 | 0 | 0 | 0 | 0 | 0 |
| 34 | 5,947 | 574 | 174 | 62 | 6,808 |
| 36/151 | 5,947 | 574 | 174 | 62 | 6,808 |
| 37 | 13,236 | 1,279 | 386 | 137 | 15,153 |
| 39 | 14,032 | 2,616 | 95 | 4 | 16,881 |
| 154 | 796 | 1,348 | 268 | 66 | 2,498 |
| 153 | 19,183 | 1,842 | 1 | 0 | 21,191 |
| 42 | 0 | 11 | 559 | 199 | 770 |

Recoveries*

| | |
|---|---|
| Ethane | 0.60% |
| Propane | 99.91% |
| Butanes+ | 100.00% |

Power

| | | |
|---|---|---|
| Residue Gas Compression | 11,656 HP | [19,162 kW] |

*(Based on un-rounded flow rates)

A comparison of Tables III and VI shows that, compared to the prior art, the FIG. 8 process improves propane recovery from 98.46% to 99.91% and butane+recovery from 99.98% to 100.00%. Comparison of Tables III and VI further shows that these increased product yields were achieved using about 3% less power than the prior art. In terms of the recovery efficiency (defined by the quantity of $C_3$ components and heavier components recovered per unit of power), the FIG. 8 process represents more than a 4% improvement over the prior art of the FIG. 3 process. The economic impact of these improved recoveries and reduced power consumption is significant. Using an average incremental value $ 0.69/gallon [€165/m$^3$] for hydrocarbon liquids compared to the corresponding hydrocarbon gases and a value of $ 3.00/MMBTU [€2.58/GJ] for fuel gas, the improved recoveries and reduced power represent more than US$ 590,000 [€530,000] of additional annual revenue for the plant operator.

The superior performance of the FIG. 8 process compared to the prior art of the FIG. 3 process is due to two key additions to its processing assembly 117 compared to processing assembly 117 in the FIG. 3 process. The first is cooling section 117*a* which allows further cooling of stream 36*a* leaving heat exchanger 12, reducing the amount of flashing across expansion valve 23 so that there is more liquid in the flash expanded stream supplied to rectifying section 117*b* in the FIG. 8 process than to rectifying section 117*a* in the FIG. 3 process. This in turn provides more cooling of the partially rectified vapor stream in the heat and mass transfer means in rectifying section 117*b* as the liquid in the flash expanded stream is vaporized, which allows it to condense more of the heavier components from the partially rectified vapor stream and thereby more completely rectify the stream.

The second key addition is absorbing section 117*c* which provides partial rectification of the combined vapor stream arising from separator section 117*d*. Contacting the combined vapor stream with the cold condensed liquid leaving the bottom of the heat and mass transfer means in rectifying section 117*b* condenses and absorbs $C_3$ components and heavier components from the combined vapor stream, before the resulting partially rectified vapor stream enters the heat and mass transfer means in rectifying section 117*b*. This reduces the load on rectifying section 117*b* and allows a greater degree of rectification in this section of processing assembly 117.

The net effect of these two additions is to allow more effective rectification of column overhead vapor stream 39 in processing assembly 117 of the FIG. 8 process, which also allows deethanizer column 17 to operate at a higher pressure. The more effective rectification provides higher product recoveries and the higher column pressure reduces the residue gas compression power, increasing the recovery efficiency of the FIG. 8 process by more than 4% compared to the prior art of the FIG. 3 process. The FIGS. 6 and 7 embodiments of the present invention can likewise be easily reconfigured to operate in this same fashion, so that all of these embodiments allow the plant operator to recover $C_2$ components in the bottom liquid product when product prices are high or to reject $C_2$ components to the residue gas product when product prices are low, thereby maximizing the revenue for the plant as economic conditions change.

Other Embodiments

Figure 6:
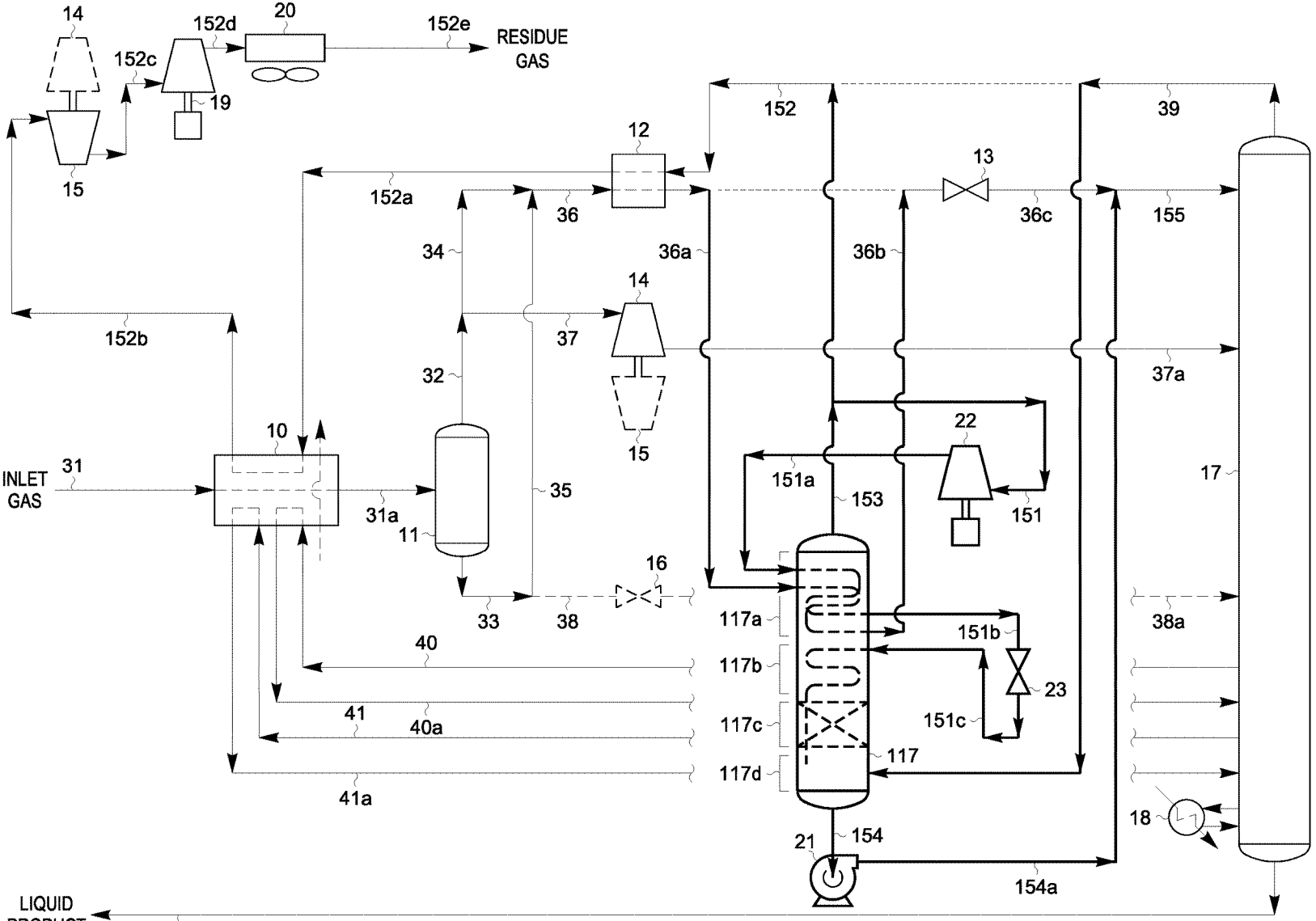
FIGS. 6 through 14 are flow diagrams illustrating alternative means of application of the present invention to a natural gas processing plant.
Figure 7:
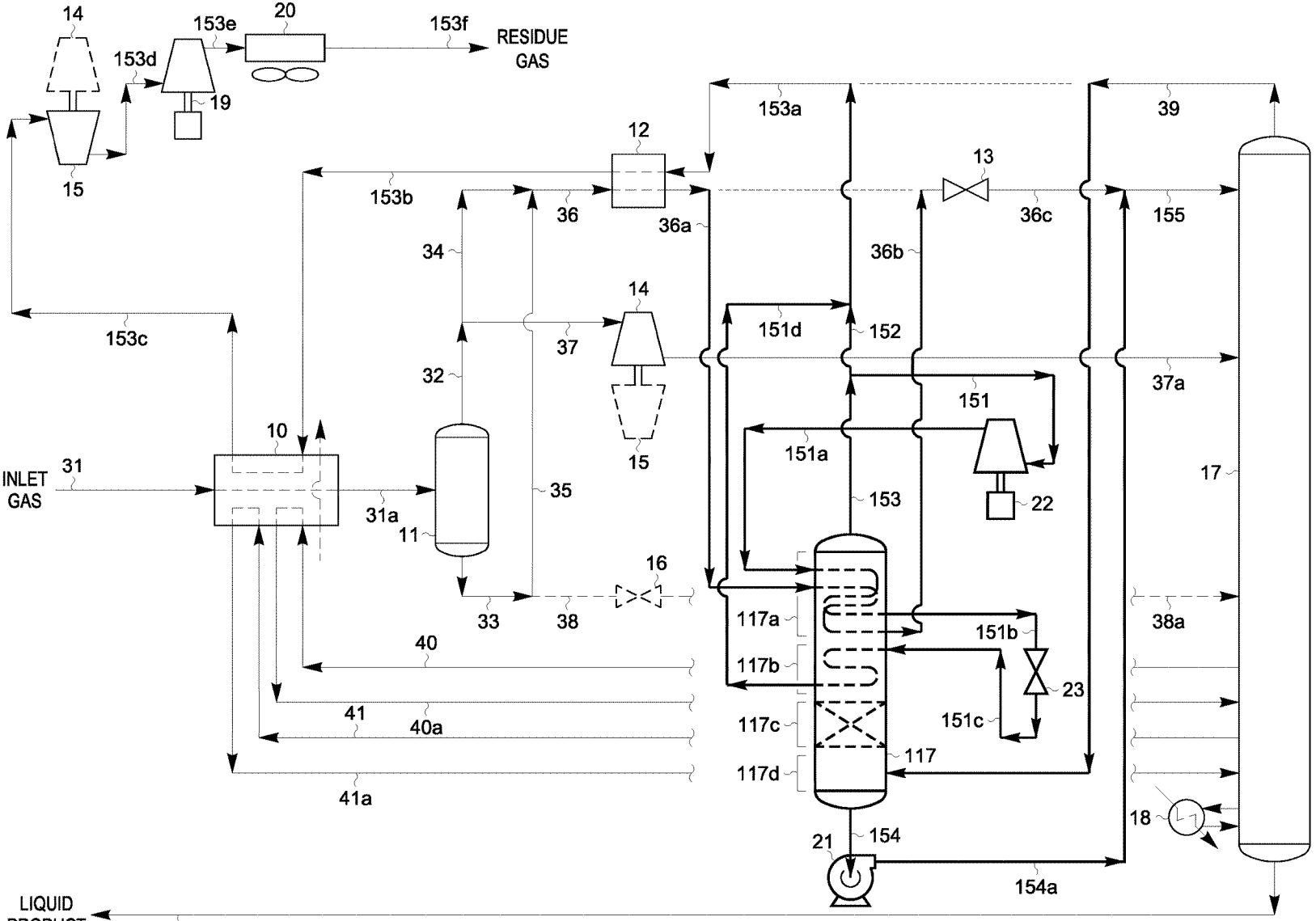

In the embodiment of the present invention shown in FIG. 5, column overhead vapor stream 39 is the source of the gas (stream 151) supplied to reflux compressor 22. Some applications may favor using outlet vapor stream 153 from processing assembly 117 for the source as shown in FIGS. 6 and 7. In some cases, it may be advantageous to send the flash expanded stream (stream 151*c*) directly to the residue gas after it has been heated in rectifying section 117*b* of processing assembly 117 as shown in FIG. 7, rather than combine it with the remaining portion (stream 152) of column overhead vapor stream 39 as shown in the FIG. 5 embodiment or with column overhead vapor stream 39 as shown in the FIG. 6 embodiment. The choice of which embodiment is best for a given application will generally depend on factors such as the feed gas composition and the desired recovery level for the $C_2$ components.

Figure 9:
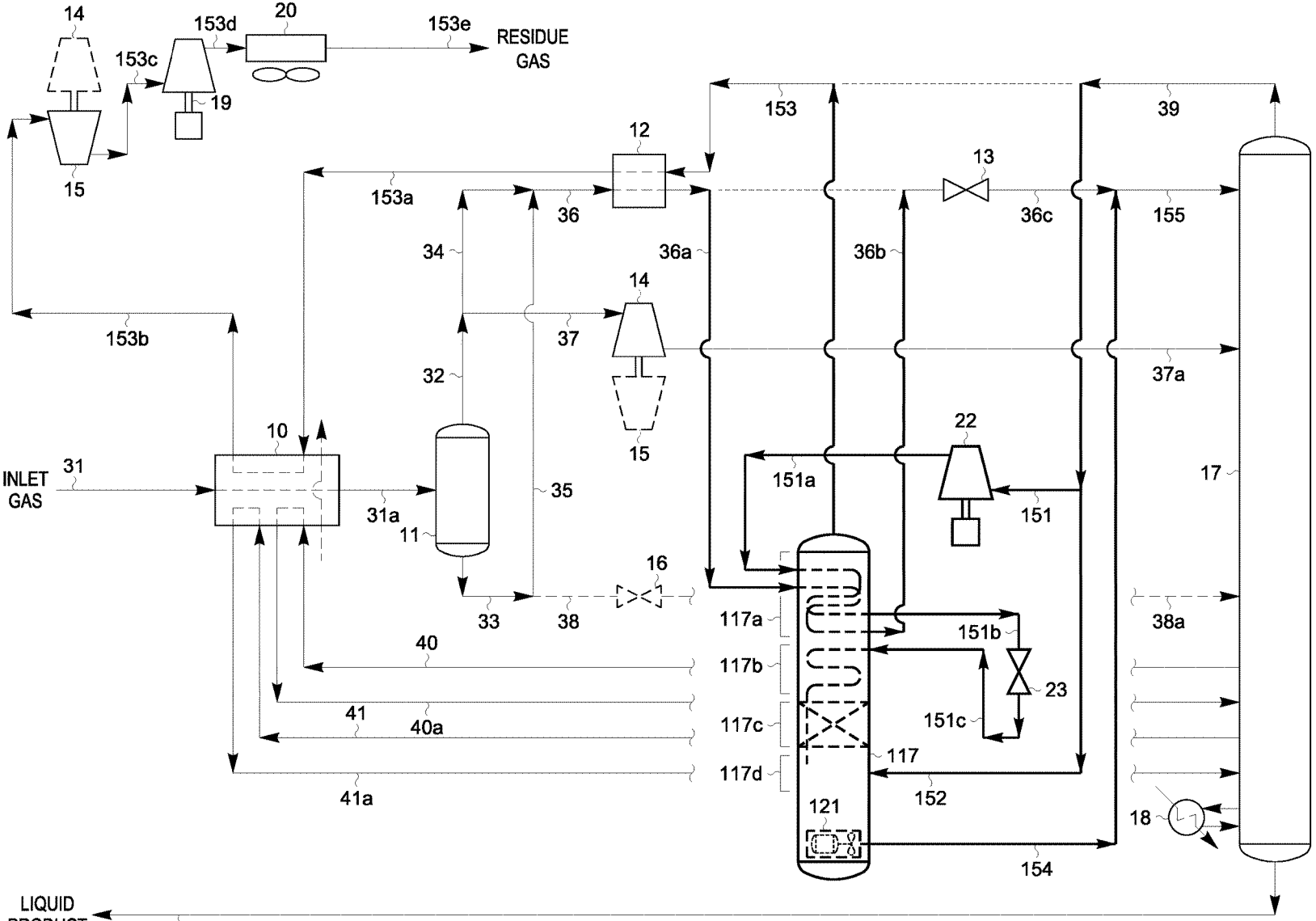
Figure 10:
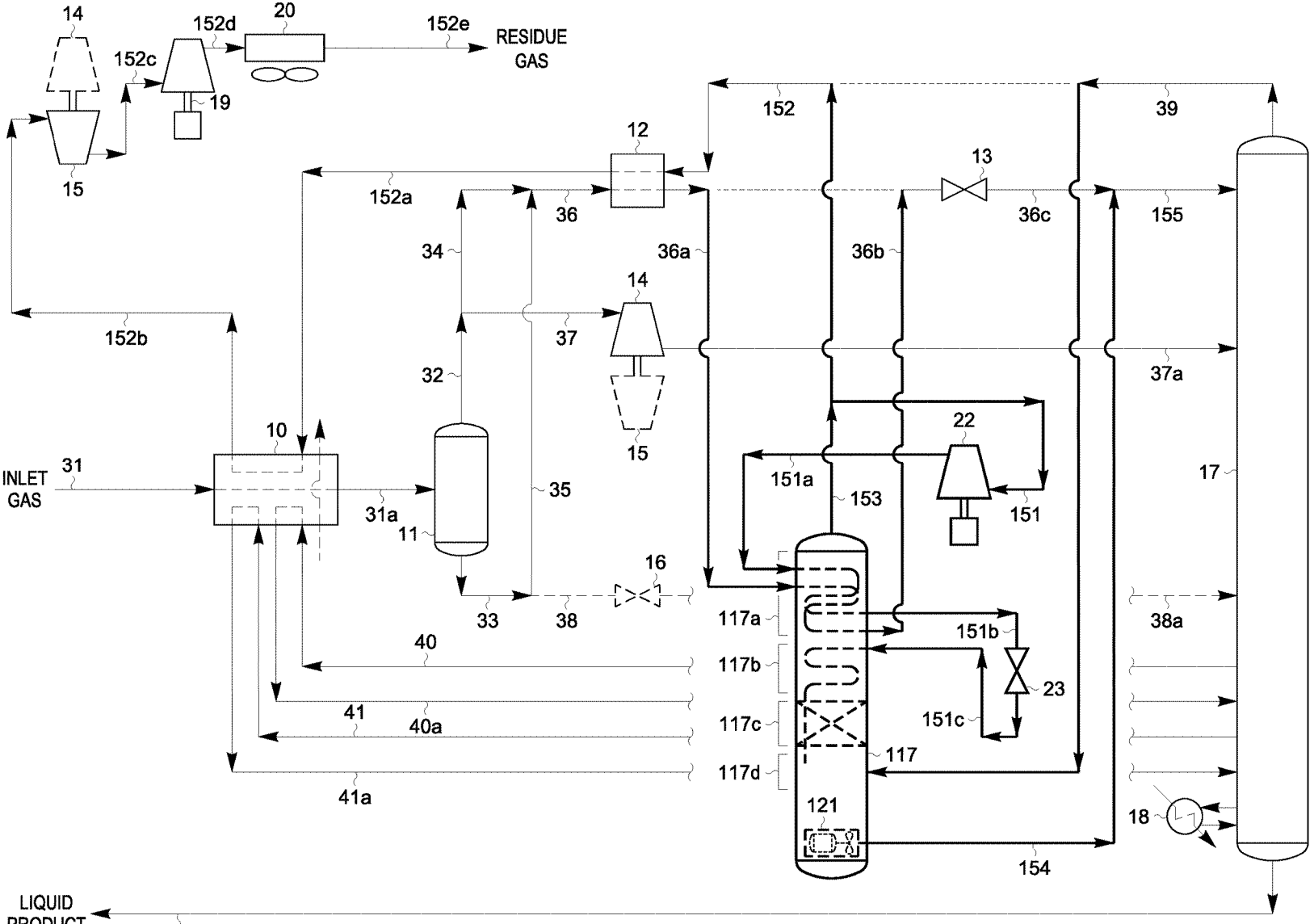
Figure 11:
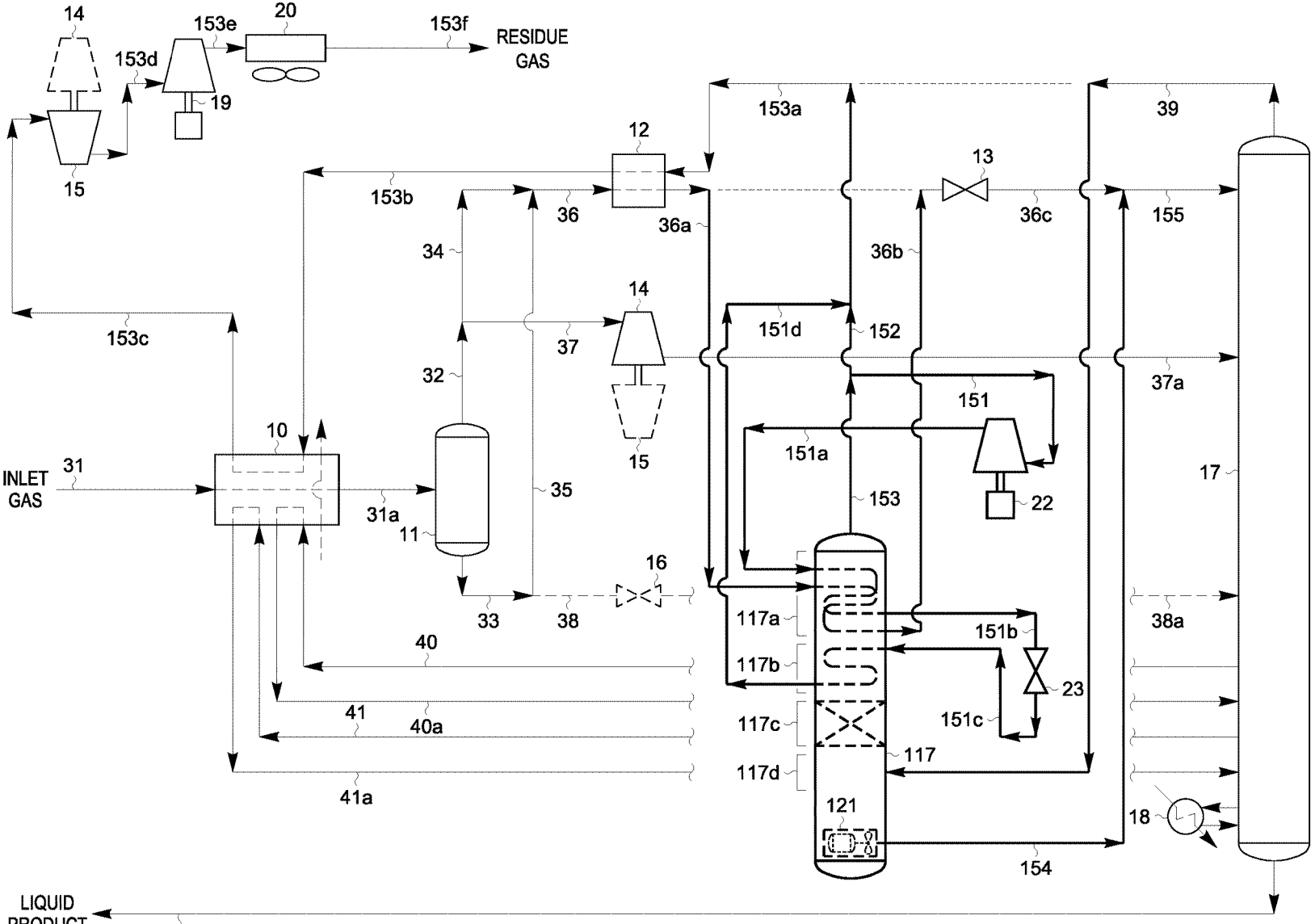

Some circumstances may favor also mounting the liquid pump inside the processing assembly to further reduce the number of equipment items and the plot space requirements. Such embodiments are shown in FIGS. 9, 10, and 11, with pump 121 mounted inside processing assembly 117 as shown to send the combined liquid stream from separator section 117*d* via conduit 154 to combine with stream 36*c* and form combined feed stream 155 that is supplied as the top feed to column 17. The pump and its driver may both be mounted inside the processing assembly if a submerged pump or canned motor pump is used, or just the pump itself may be mounted inside the processing assembly (using a magnetically-coupled drive for the pump, for instance). For either option, the potential for atmospheric releases of hydrocarbons that may damage the environment is reduced still further.

Figure 12:
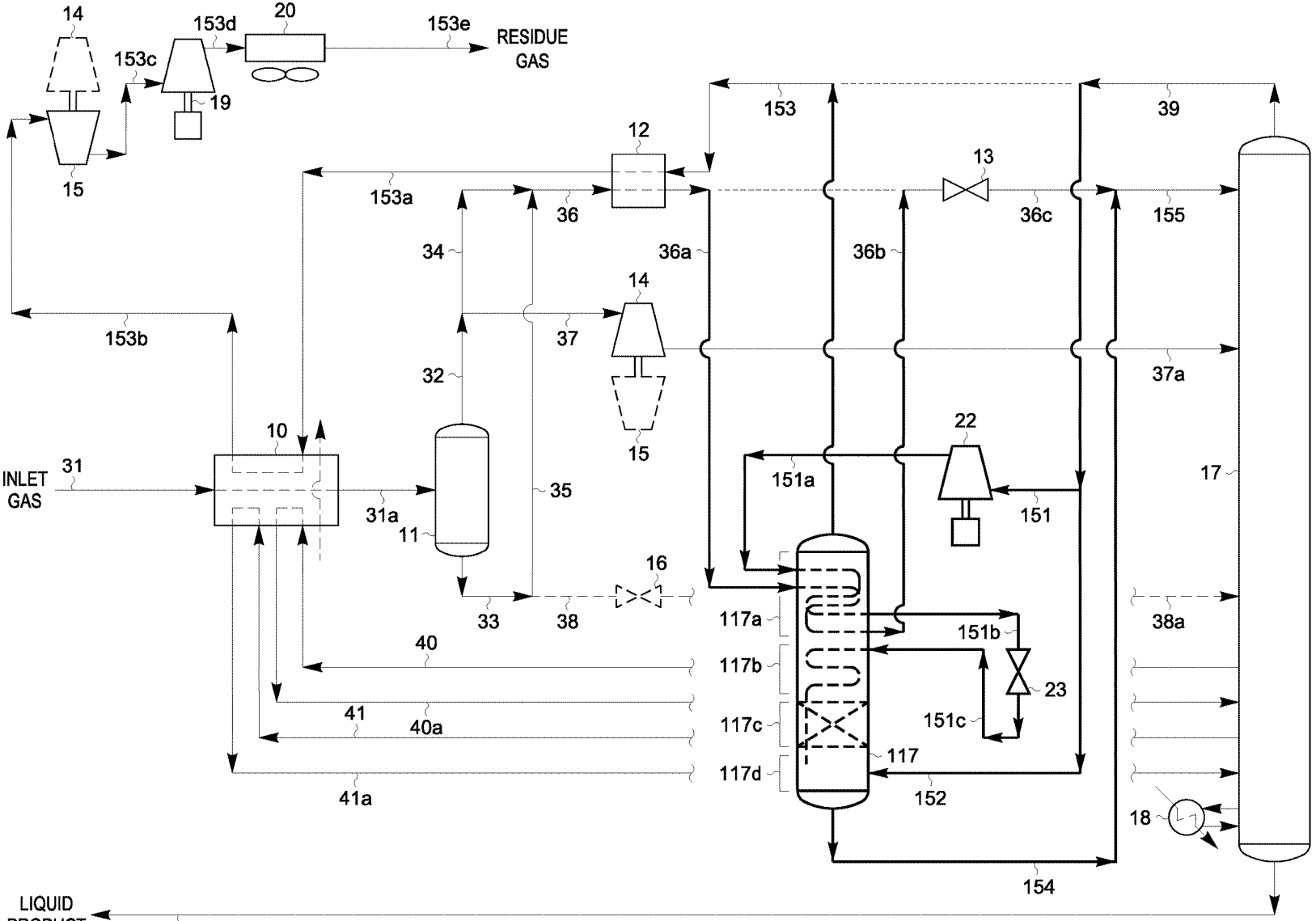
Figure 13:
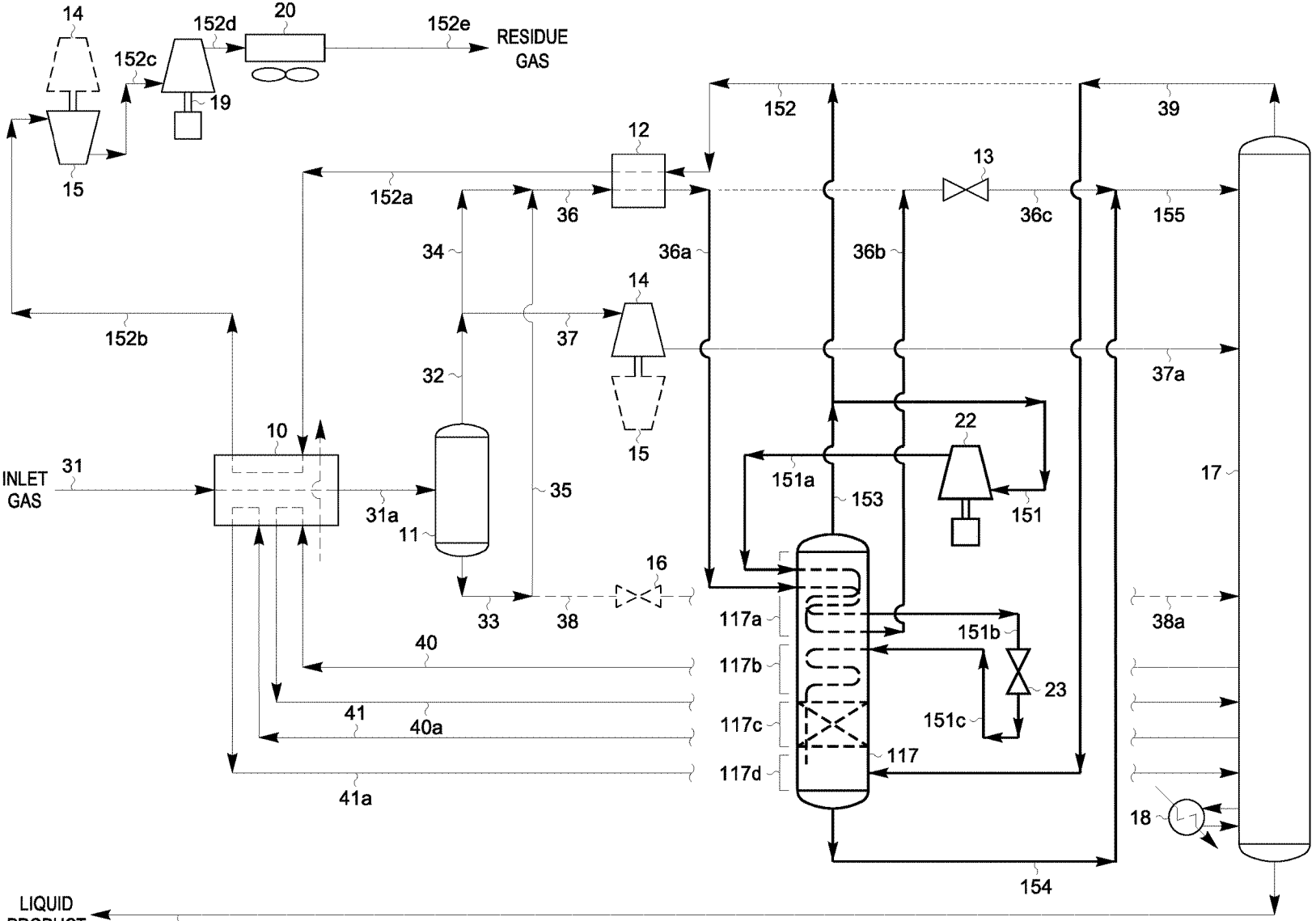
Figure 14:
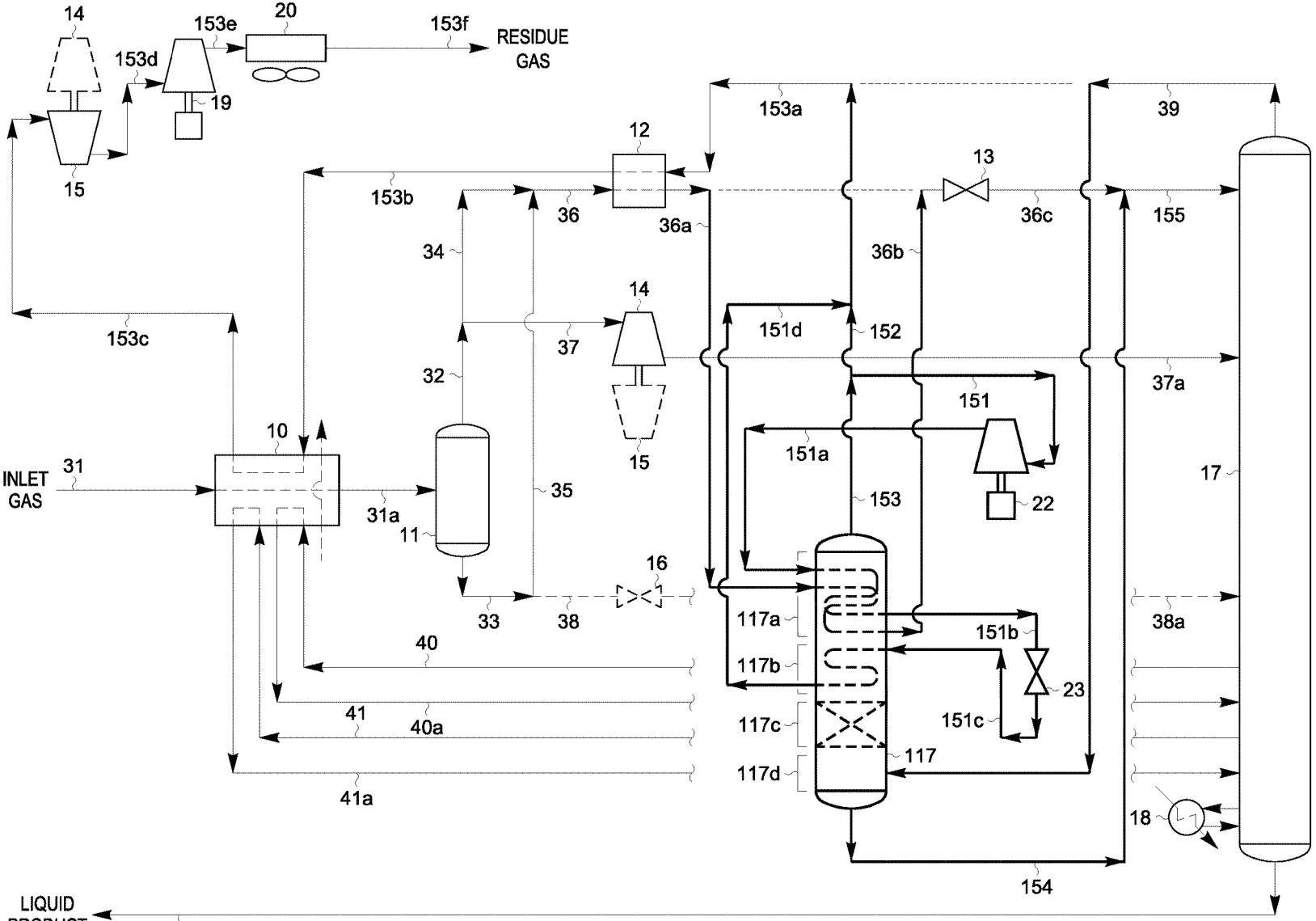

Some circumstances may favor locating the processing assembly at a higher elevation than the top feed point on fractionation column 17. In such cases, it may be possible for combined liquid stream 154 to flow by gravity head and combine with stream 36*c* so that the resulting combined feed stream 155 then flows to the top feed point on fractionation column 17 as shown in FIGS. 12, 13, and 14, eliminating the need for pump 21/121 shown in the FIGS. 5 through 11 embodiments.

Depending on the feed gas composition, the desired recovery level for the $C_2$ components or the $C_3$ components, and other factors, it may be desirable to completely vaporize flash expanded stream 151*c* in the heat and mass transfer means in rectifying section 117*b* of processing assembly 117 in the FIGS. 5, 6, 9, 10, 12, and 13 embodiments of the present invention. In such cases, processing assembly 117 may not require separator section 117*d*.

The present invention provides improved recovery of $C_2$ components, $C_3$ components, and heavier hydrocarbon components per amount of utility consumption required to operate the process. An improvement in utility consumption required for operating the process may appear in the form of reduced power requirements for compression or re-compression, reduced power requirements for external refrigeration, reduced energy requirements for supplemental heating, or a combination thereof.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process (a) said gas stream is treated in one or more heat exchange steps and at least one division step to produce at least a first stream that has been cooled under pressure to condense at least a majority of said first stream, and at least a second stream that has been cooled under pressure;

(b) said condensed first stream is expanded to a lower pressure whereby said condensed first stream is further cooled, and thereafter supplied at a top feed position on a distillation column that produces at least an overhead vapor stream and a bottom liquid stream;

(c) said cooled second stream is expanded to said lower pressure, and thereafter supplied to said distillation column at a mid-column feed position; and (d) at least said expanded further cooled first stream and said expanded second stream are fractionated in said distillation column at said lower pressure whereby the components of said relatively less volatile fraction are recovered in said bottom liquid stream and said volatile residue gas fraction is discharged as said overhead vapor stream;

the improvement wherein (1) said overhead vapor stream is directed to an absorbing means housed in a processing assembly to be contacted with a condensed stream and thereby condense less volatile components to form a partially rectified vapor stream;

(2) said partially rectified vapor stream is collected from an upper region of said absorbing means and directed to a heat and mass transfer means housed in said processing assembly, whereby said partially rectified vapor stream is cooled while simultaneously condensing said partially rectified vapor stream's less volatile components, thereby forming a further rectified vapor stream and said condensed stream, whereupon said condensed stream is directed to said absorbing means;

(3) said further rectified vapor stream is directed to a heat exchange means housed in said processing assembly and heated, thereafter discharging said heated further rectified vapor stream from said processing assembly as an outlet vapor stream;

(4) said outlet vapor stream is divided into a first portion and a second portion;

(5) said first portion is compressed to higher pressure to form a compressed stream;

(6) said compressed stream is directed to said heat exchange means and cooled to condense at least a majority of said compressed stream, thereby to supply at least a portion of the heating of step (3) and form another condensed stream;

(7) said another condensed stream is expanded to said lower pressure, whereby said another condensed stream is further cooled to form a flash expanded stream;

(8) said flash expanded stream is heated in said heat and mass transfer means, thereby to supply at least a portion of the cooling of step (2) and form a heated flash expanded stream;

(9) said heated flash expanded stream is combined with said second portion to form said volatile residue gas fraction;

(10) said condensed first stream is directed to said heat exchange means and further cooled under pressure, thereby to supply at least a portion of the heating of step (3) and form a further cooled first stream;

(11) said further cooled first stream is expanded to said lower pressure, thereby forming said expanded further cooled first stream;

(12) a distillation liquid stream is collected from a lower region of said absorbing means and combined with said expanded further cooled first stream to form a combined feed stream, whereupon said combined feed stream is directed to said top feed position on said distillation column;

(13) at least said combined feed stream and said expanded second stream are fractionated in said distillation column at said lower pressure whereby the components of said relatively less volatile fraction are recovered in said bottom liquid stream; and

(14) the quantities and temperatures of said feed streams to said distillation column are effective to maintain the overhead temperature of said distillation column at a temperature whereby the major portions of the components in said relatively less volatile fraction are recovered in said bottom liquid stream.

2. The process according to claim 1 wherein (1) said gas stream is cooled under pressure in said one or more heat exchange steps sufficiently to partially condense said gas stream;

(2) said partially condensed gas stream is separated thereby to provide a vapor stream and at least one liquid stream;

(3) said vapor stream is divided in said at least one division step to produce at least said first stream and said second stream;

(4) said first stream is cooled under pressure in said one or more heat exchange steps to condense at least a majority of said first stream and thereby form said condensed first stream;

(5) at least a portion of said at least one liquid stream is expanded to said lower pressure, whereupon said expanded liquid stream is supplied to said distillation column at a lower mid-column feed position below said mid-column feed position; and (6) at least said combined feed stream, said expanded second stream, and said expanded liquid stream are fractionated in said distillation column at said lower pressure whereby the components of said relatively less volatile fraction are recovered in said bottom liquid stream.

3. The process according to claim 2 wherein (1) said vapor stream is divided in said at least one division step to produce at least a first vapor stream and said second stream;

(2) said first vapor stream is combined with at least a portion of said at least one liquid stream to form said first stream; and (3) any remaining portion of said at least one liquid stream is expanded to said lower pressure, whereupon said expanded liquid stream is supplied to said distillation column at said lower mid-column feed position.

4. The process according to claim 1, 2, or 3 wherein (1) said heated flash expanded stream is combined with said overhead vapor stream to form a combined vapor stream;

(2) said combined vapor stream is directed to said absorbing means to be contacted with said condensed stream and thereby form said partially rectified stream; and (3) said second portion is discharged as said volatile residue gas fraction.

5. The process according to claim 4 wherein (1) said heated flash expanded stream is directed to a separating means housed in said processing assembly and separated therein into a vapor fraction and a liquid fraction;

(2) said vapor fraction is combined with said overhead vapor stream to form said combined vapor stream;

(3) said liquid fraction is combined with said distillation liquid stream to form a combined liquid stream; and (4) said combined liquid stream is combined with said expanded further cooled first stream to form said combined feed stream.

6. The process according to claim 4 wherein (1) said overhead vapor stream is divided into said first portion and said second portion;

(2) said second portion is combined with said heated flash expanded stream to form said combined vapor stream; and (3) said outlet vapor stream is discharged as said volatile residue gas fraction.

7. The process according to claim 5 wherein (1) said overhead vapor stream is divided into said first portion and said second portion;

(2) said second portion is combined with said vapor fraction to form said combined vapor stream; and (3) said outlet vapor stream is discharged as said volatile residue gas fraction.

8. The process according to claim 1, 2, or 3 wherein said distillation liquid stream is pumped to higher pressure using a pumping means.

9. The process according to claim 4 wherein said distillation liquid stream is pumped to higher pressure using a pumping means.

10. The process according to claim 5 wherein said combined liquid stream is pumped to higher pressure using a pumping means.

11. The process according to claim 6 wherein said distillation liquid stream is pumped to higher pressure using a pumping means.

12. The process according to claim 7 wherein said combined liquid stream is pumped to higher pressure using a pumping means.

13. The process according to claim 8 wherein said pumping means is housed in said processing assembly.

14. The process according to claim 9 wherein said pumping means is housed in said processing assembly.

15. The process according to claim 10 wherein said pumping means is housed in said processing assembly.

16. The process according to claim 11 wherein said pumping means is housed in said processing assembly.

17. The process according to claim 12 wherein said pumping means is housed in said processing assembly.

18. In an apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in said apparatus there being (a) one or more heat exchange means and at least one dividing means to produce at least a first stream that has been cooled under pressure to condense at least a majority of said first stream, and at least a second stream that has been cooled under pressure;

(b) a first expansion means connected to receive said condensed first stream under pressure and expand said condensed first stream to a lower pressure, whereby said first stream is further cooled;

(c) a distillation column connected to said first expansion means to receive said expanded further cooled first stream at a top feed position, with said distillation column producing at least an overhead vapor stream and a bottom liquid stream;

(d) a second expansion means connected to receive said cooled second stream under pressure and expand said cooled second stream to said lower pressure;

(e) said distillation column further connected to said second expansion means to receive said expanded second stream at a mid-column feed position; and (f) said distillation column adapted to fractionate at least said expanded further cooled first stream and said expanded second stream at said lower pressure whereby the components of said relatively less volatile fraction are recovered in said bottom liquid stream and said volatile residue gas fraction is discharged as said overhead vapor stream;

the improvement wherein said apparatus includes (1) an absorbing means housed in a processing assembly and connected to said distillation column to receive said overhead vapor stream and contact said overhead vapor stream with a condensed stream, thereby condensing said overhead vapor stream's less volatile components and forming a partially rectified vapor stream;

(2) a heat and mass transfer means housed in said processing assembly and connected to said absorbing means to receive said partially rectified vapor stream from an upper region of said absorbing means, whereby said partially rectified vapor stream is cooled while simultaneously condensing said partially rectified vapor stream's less volatile components, thereby forming a further rectified vapor stream and said condensed stream, said heat and mass transfer means being further connected to said absorbing means to direct said condensed stream to said absorbing means;

(3) another heat exchange means housed in said processing assembly and connected to said heat and mass transfer means to receive said further rectified vapor stream and heat said further rectified vapor stream, thereafter discharging said heated further rectified vapor stream from said processing assembly as an outlet vapor stream;

(4) a second dividing means connected to said processing assembly to receive said outlet vapor stream and divide said outlet vapor stream into a first portion and a second portion;

(5) a compressing means connected to said second dividing means to receive said first portion and compress said first portion to higher pressure, thereby forming a compressed stream;

(6) said another heat exchange means further connected to said compressing means to receive said compressed stream and cool said compressed stream to condense at least a majority of said compressed stream, thereby to supply at least a portion of the heating of step (3) and forming another condensed stream;

(7) a third expansion means connected to said another heat exchange means to receive said another condensed stream and expand said another condensed stream to said lower pressure, thereby forming a flash expanded stream;

(8) said heat and mass transfer means further connected to said third expansion means to receive said flash expanded stream and heat said flash expanded stream, thereby to supply the cooling of step (2) and forming a heated flash expanded stream;

(9) a first combining means connected to said heat and mass transfer means and to said second dividing means to receive said heated flash expanded stream and said second portion and form said volatile residue gas fraction;

(10) said another heat exchange means further connected to said one or more heat exchange means and said at least one dividing means to receive said condensed first stream and further cool said condensed first stream under pressure, thereby to supply at least a portion of the heating of step (3) and forming a further cooled first stream;

(11) said first expansion means being adapted to connect said first expansion means to said another heat exchange means to receive said further cooled first stream and expand said further cooled first stream to said lower pressure, thereby forming said expanded further cooled first stream;

(12) a second combining means connected to said absorbing means and to said first expansion means to receive a distillation liquid stream from a lower region of said absorbing means and said expanded further cooled first stream and form a combined feed stream, said second combining means being further connected to said distillation column to supply said combined feed stream at said top feed position of said distillation column;

(13) said distillation column being adapted to fractionate at least said combined feed stream and said expanded second stream at said lower pressure whereby the components of said relatively less volatile fraction are recovered in said bottom liquid stream; and wherein quantities and temperatures of said feed streams to said distillation column are controlled to maintain the overhead temperature of said distillation column at a temperature whereby the major portions of the components in said relatively less volatile fraction are recovered in said bottom liquid stream.

19. The apparatus according to claim 18 wherein (1) said one or more heat exchange means is adapted to cool said gas stream under pressure sufficiently to partially condense said gas stream under pressure;

(2) a feed separating means is connected to said one or more heat exchange means to receive said partially condensed gas stream and separate said partially condensed gas stream into a vapor stream and at least one liquid stream;

(3) said at least one dividing means is connected to said feed separating means and adapted to receive said vapor stream and divide said vapor stream into at least said first stream and said second stream;

(4) said one or more heat exchange means is connected to said at least one dividing means and adapted to receive said first stream and cool said first stream sufficiently to condense at least a majority of said first stream, thereby forming said condensed first stream;

(5) said second expansion means is connected to said at least one dividing means and adapted to receive said second stream and expand said second stream to said lower pressure, thereby forming said expanded second stream;

(6) a fourth expansion means is connected to said feed separating means to receive at least a portion of said at least one liquid stream and expand said at least one liquid stream to said lower pressure, said fourth expansion means being further connected to said distillation column to supply said expanded liquid stream to said distillation column at a lower mid-column feed position below said mid-column feed position; and (7) said distillation column is adapted to fractionate at least said combined feed stream, said expanded second stream, and said expanded liquid stream at said lower pressure whereby the components of said relatively less volatile fraction are recovered in said bottom liquid stream.

20. The apparatus according to claim 19 wherein (1) said at least one dividing means is adapted to divide said vapor stream into at least a first vapor stream and said second stream;

(2) a vapor-liquid combining means is connected to said at least one dividing means and to said feed separating means to receive said first vapor stream and at least a portion of said at least one liquid stream and form said first stream;

(3) said one or more heat exchange means is connected to said vapor-liquid combining means and adapted to receive said first stream and cool said first stream sufficiently to condense at least a majority of said first stream, thereby forming said condensed first stream; and (4) said fourth expansion means is adapted to receive any remaining portion of said at least one liquid stream and expand said any remaining portion of said at least one liquid stream to said lower pressure, whereupon said expanded liquid stream is supplied to said distillation column at said lower mid-column feed position.

21. The apparatus according to claim 18, 19, or 20 wherein (1) said first combining means is adapted to be connected to said heat and mass transfer means and to said distillation column to receive said heated flash expanded stream and said overhead vapor stream and form a combined vapor stream;

(2) said first combining means is further connected to said absorbing means to direct said combined vapor stream to said absorbing means, said absorbing means being adapted to contact said combined vapor stream with said condensed stream, thereby forming said partially rectified vapor stream; and (3) said second dividing means is adapted to discharge said second portion as said volatile residue gas fraction.

22. The apparatus according to claim 21 wherein (1) a separating means is housed in said processing assembly and connected to receive said heated flash expanded stream and separate said heated flash expanded stream therein into a vapor fraction and a liquid fraction;

(2) said first combining means is adapted to be connected to said separating means and to said distillation column to receive said vapor fraction and said overhead vapor stream and form said combined vapor stream;

(3) a third combining means is connected to said absorbing means and to said separating means to receive said distillation liquid stream from said lower region of said absorbing means and said liquid fraction and form a combined liquid stream; and (4) said second combining means is adapted to be connected to said third combining means and to said first expansion means to receive said combined liquid stream and said expanded further cooled first stream and form said combined feed stream.

23. The apparatus according to claim 21 wherein (1) said second dividing means is adapted to be connected to said distillation column to receive said overhead vapor stream and divide said overhead vapor stream into said first portion and said second portion;

(2) said first combining means is adapted to be connected to said heat and mass transfer means and to said second dividing means to receive said heated flash expanded stream and said second portion, thereby forming said combined vapor stream; and (3) said processing assembly is adapted to discharge said outlet vapor as said volatile residue gas fraction.

24. The apparatus according to claim 22 wherein (1) said second dividing means is adapted to be connected to said distillation column to receive said overhead vapor stream and divide said overhead vapor stream into said first portion and said second portion;

(2) said first combining means is adapted to be connected to said separating means and to said second dividing means to receive said vapor fraction and said second portion, thereby forming said combined vapor stream; and (3) said processing assembly is adapted to discharge said outlet vapor as said volatile residue gas fraction.

25. The apparatus according to claim 18, 19, or 20 wherein (1) a pumping means is connected to said absorbing means to receive said distillation liquid stream from said lower region of said absorbing means and pump said distillation liquid stream to higher pressure, thereby forming a pumped distillation liquid stream; and (2) said second combining means is adapted to be connected to said pumping means and to said first expansion means to receive said pumped distillation liquid stream and said expanded further cooled first stream and form said combined feed stream.

26. The apparatus according to claim 21 wherein (1) a pumping means is connected to said absorbing means to receive said distillation liquid stream from said lower region of said absorbing means and pump said distillation liquid stream to higher pressure, thereby forming a pumped distillation liquid stream; and (2) said second combining means is adapted to be connected to said pumping means and to said first expansion means to receive said pumped distillation liquid stream and said expanded further cooled first stream and form said combined feed stream.

27. The apparatus according to claim 22 wherein (1) a pumping means is connected to said third combining means to receive said combined liquid stream and pump said combined liquid stream to higher pressure, thereby forming a pumped combined liquid stream; and (2) said second combining means is adapted to be connected to said pumping means and to said first expansion means to receive said pumped combined liquid stream and said expanded further cooled first stream and form said combined feed stream.

28. The apparatus according to claim 23 wherein (1) a pumping means is connected to said absorbing means to receive said distillation liquid stream from said lower region of said absorbing means and pump said distillation liquid stream to higher pressure, thereby forming a pumped distillation liquid stream; and (2) said second combining means is adapted to be connected to said pumping means and to said first expansion means to receive said pumped distillation liquid stream and said expanded further cooled first stream and form said combined feed stream.

29. The apparatus according to claim 24 wherein (1) a pumping means is connected to said third combining means to receive said combined liquid stream and pump said combined liquid stream to higher pressure, thereby forming a pumped combined liquid stream; and (2) said second combining means is adapted to be connected to said pumping means and to said first expansion means to receive said pumped combined liquid stream and said expanded further cooled first stream and form said combined feed stream.

30. The apparatus according to claim 25 wherein said pumping means is housed in said processing assembly.

31. The apparatus according to claim 26 wherein said pumping means is housed in said processing assembly.

32. The apparatus according to claim 27 wherein said pumping means is housed in said processing assembly.

33. The apparatus according to claim 28 wherein said pumping means is housed in said processing assembly.

34. The apparatus according to claim 29 wherein said pumping means is housed in said processing assembly.

* * * * *